US007861867B1

(12) United States Patent
Derrick

(10) Patent No.: US 7,861,867 B1
(45) Date of Patent: Jan. 4, 2011

(54) MATERIAL SCREENING SYSTEMS

(76) Inventor: John Robert Derrick, 1428 E. Aire Ave., Phoenix, AZ (US) 85022

( * ) Notice: Subject to any disclaimer, the term of this patent is extended or adjusted under 35 U.S.C. 154(b) by 617 days.

(21) Appl. No.: 11/741,343

(22) Filed: Apr. 27, 2007

Related U.S. Application Data

(60) Provisional application No. 60/807,162, filed on Jul. 12, 2006, provisional application No. 60/799,276, filed on May 9, 2006.

(51) Int. Cl.
*B07B 1/46* (2006.01)

(52) U.S. Cl. ..... 209/412; 209/393; 209/394; 209/413; 209/668

(58) Field of Classification Search ..... 209/260, 209/281, 352, 676, 675, 660, 668, 414, 420, 209/393, 394, 395, 409, 412
See application file for complete search history.

(56) References Cited

U.S. PATENT DOCUMENTS

| | | | | |
|---|---|---|---|---|
| 1,109,866 | A | 9/1914 | Nunamaker | |
| 4,099,344 | A * | 7/1978 | Ruemeli | 47/19.1 |
| 5,544,762 | A * | 8/1996 | Liimatainen et al. | 209/675 |
| 6,098,811 | A * | 8/2000 | Schaefer | 209/395 |
| 6,357,597 | B1 * | 3/2002 | Theeler, Sr. | 209/395 |
| 6,439,393 | B1 * | 8/2002 | Zeller | 209/405 |
| 6,712,218 | B2 * | 3/2004 | Nierop | 209/420 |
| 6,820,748 | B2 * | 11/2004 | Fallon | 209/311 |
| 6,863,182 | B2 * | 3/2005 | Zeller | 209/393 |
| 7,537,123 | B2 * | 5/2009 | Snow | 209/394 |
| 2004/0020830 | A1 | 2/2004 | Nierop | |
| 2007/0256960 | A1 * | 11/2007 | Dees | 209/393 |
| 2008/0093270 | A1 * | 4/2008 | Zeller | 209/405 |
| 2010/0059416 | A1 * | 3/2010 | Snow | 209/414 |

FOREIGN PATENT DOCUMENTS

GB 2244941 A * 12/1991

* cited by examiner

*Primary Examiner*—Joseph C Rodriguez
(74) *Attorney, Agent, or Firm*—Stoneman Law Patent Group; Martin L. Stoneman

(57) ABSTRACT

A reconfigurable grizzly-type system providing improved field processing of ore, rock, and soil. The system provides reconfigurable screening of rocks, rubble, gravel, and debris from soil based on material size. The system also provides improvements related to efficient storage and transportation.

28 Claims, 18 Drawing Sheets

MATERIAL SCREENING SYSTEMS

CROSS-REFERENCE TO RELATED APPLICATIONS

The present application is related to my prior provisional patent application Ser. No. 60/799,276, filed May 9, 2006, entitled "Reconfigurable Material Sorting Systems", from which I claim priority. And the present application is also related to my prior provisional patent application Ser. No. 60/807,162, filed Jul. 12, 2006, entitled "Material Screening Systems", from which I claim priority. Both of these prior applications are incorporated herein by this reference and neither are admitted to be prior art with respect to the present invention by their mention in this cross-reference section.

BACKGROUND

This invention relates material screening systems. More particularly, it relates to providing a system for improved field processing of ore, rock, and soil. Even more particularly, this invention relates to providing a reconfigurable system for screening of rocks, rubble, gravel, and debris from soil, particularly screening based on material size.

Construction and mining operations often involve the screening of excavated materials based on material size. For example, raw soils excavated in the field are often sorted to remove large rock and debris, thus producing materials suitable for use in roadway subgrades, building pads, landscape soils, etc. This process is often referred to as "field processing".

Field processing of excavated materials often takes place during a relatively short phase of a construction process, such as during the site preparation of a road, bridge, or building structure. Equipment used in such "limited duration" operations must therefore be easily and efficiently transportable to and from the construction site. In general the physical size of such equipment is large, requiring specialized transport. Cost and availability of such specialized transport is a significant factor contributing to overall project costs. Clearly, more efficient transport of processing equipment would be of great value in this field. In addition, processing equipment that is quickly and easily adjustable to allow for changes in the size of material selected for separation, in combination with the above-described features, is needed.

OBJECTS AND FEATURES OF THE INVENTION

A primary object and feature of the present invention is to provide a system to solve the above-mentioned problems and meet the above-mentioned needs. Another primary object and feature of the present invention is to provide an improved system for separating selected sizes of rock, stones, and debris from excavated earth. It is a further object and feature of the present invention to provide such a system that is reconfigurable to a compact arrangement for transportation and that securely locks into such a compact stowed arrangement.

It is another object and feature of the present invention to provide such a system that uses cambered support members to provide superior strength. It is another object and feature of the present invention to provide such a system that is quickly and easily adjustable to allow for changes in the size of material selected for separation. It is another object and feature of the present invention to provide such a system that is quickly and easily adjustable in screen angle to accommodate different types of materials selected for separation. It is a further object and feature of the present invention to provide such a system that is fully operable, including the angle and transportation reconfigurations, by a single user. A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a material screening system, relating to screening coarser parts of excavated material from finer parts of such excavated material, comprising: at least one screen structured and arranged to screen such coarser parts of such excavated material from such finer parts of such excavated material; at least one vertical support, structured and arranged to vertically support such at least one screen above at least one ground surface, comprising at least one front wall having at least one in-side, at least one out-side, at least one left edge, at least one right edge, at least one bottom edge, and at least one top edge; at least one left side wall, comprising at least one left front end and at least one left back end, wherein such at least one left front end is fixedly connected to such at least one left edge; at least one right side wall, comprising at least one right front end and at least one right back end, wherein such at least one right front end is fixedly connected to such at least one right edge, wherein such at least one left side wall and such at least one right side wall are substantially parallel; wherein such at least one left side wall comprises at least one left substantially vertical bar member extending generally upward from such at least one left back end; and wherein such at least one right side wall comprises at least one right substantially vertical bar member extending generally upward from such at least one right back end; wherein such at least one left side wall comprises at least one left diagonal cross-brace member structured and arranged to provide diagonal cross-brace support between such at least one front wall and such at least one left substantially vertical bar member; wherein such at least one right side wall comprises at least one right diagonal cross-brace member structured and arranged to provide diagonal cross-brace support between such at least one front wall and such at least one right substantially vertical bar member; wherein such at least one screen is attached to such at least one vertical support; and wherein such at least one screen comprises: a plurality of screen members structured and arranged to block the passage of such coarser parts of such excavated material and to allow passage of such finer parts of such excavated material; and at least one support frame structured and arranged to support such plurality of screen members; wherein such at least one support frame comprises at least one camber structured and arranged to compensate for at least one deflection generated within such at least one support frame under at least one operational load. Moreover, it provides such a material screening system, further comprising at least one adjuster structured and arranged to adjust the spacing among such plurality of screen members, wherein adjustment of such plurality of screen members adjusts the size of such coarser parts of such excavated material blocked by such plurality of screen members, and such size of such finer parts passed by such plurality of screen members. Additionally, it provides such a material screening system, wherein at least one of such plurality of screen members comprises at least one triangular cross-section, wherein the base of such at least one triangular cross-section is oriented adjacent such at least one support frame. Also, it provides such a material screening system, wherein such at least one support frame comprises at least one secondary screen mount structured and arranged to removably mount at least one secondary screen. In addition, it provides such a material screening system, further comprising at least one secondary screen, wherein such at least one secondary screen comprises at least one woven wire screen. And, it provides such a material screening system, further comprising at least one angle adjuster structured and arranged to adjust the angle of such at least one screen relative to the at least one ground surface. Further, it provides such a material screening system, wherein such at least one left substantially vertical bar member comprises at least one left angle adjuster structured and arranged to adjust the angle of such at least one left substantially vertical bar member relative to the at least one ground surface; and such at least one right substantially vertical bar member comprises at least one right angle adjuster structured and arranged to adjust the angle of such at least one right substantially vertical bar member relative to the at least one ground surface. Even further, it provides such a material screening system, wherein such at least one left angle adjuster comprises at least one left length adjuster structured and arranged to adjust the length of such at least one left substantially vertical bar member; and such at least one right angle adjuster comprises at least one right length adjuster structured and arranged to adjust the length of such at least one right substantially vertical bar member. Moreover, it provides such a material screening system, wherein such at least one left length adjuster comprises at least one left inner telescoping bar and at least one left outer telescoping sleeve; and such at least one right length adjuster comprises at least one right inner telescoping bar and at least one right outer telescoping sleeve. Additionally, it provides such a material screening system, further comprising at least one left length selector structured and arranged to selectably fix the relative positions of such at least one left inner telescoping bar and such at least one left outer telescoping sleeve; and at least one right length selector structured and arranged to selectably fix the relative positions of such at least one right inner telescoping bar and such at least one right outer telescoping sleeve. Also, it provides such a material screening system, wherein such at least one left inner telescoping bar is hingedly connected to such at least one left back end; such at least one left outer telescoping sleeve is hingedly connected to such at least one screen; such at least one right inner telescoping bar is hingedly connected to such at least one right back end; and such at least one right outer telescoping sleeve is hingedly connected to such at least one screen. In addition, it provides such a material screening system, wherein such at least one left length selector comprises at least one pin-hole through such at least one left inner telescoping bar; and at least one pin structured and arranged to pierce such at least one pin-hole and to support at least one end of such at least one left outer telescoping sleeve; and such at least one right length selector comprises at least one pin-hole through such at least one right inner telescoping bar; and at least one pin structured and arranged to pierce such at least one pin-hole and to support at least one end of such at least one right outer telescoping sleeve. And, it provides such a material screening system, wherein such at least one screen is hingedly attached to such at least one top edge of such at least one front wall. Further, it provides such a material screening system, wherein such at least one angle adjuster is structured and arranged to adjust the angle of such at least one screen between about horizontal and past vertical, relative to the at least one ground surface. Even further, it provides such a material screening system, wherein such at least one angle adjuster comprises at least one positional retainer structured and arranged to firmly retain such at least one screen in about a horizontal position during transport.

In accordance with another preferred embodiment hereof, this invention provides a material screening system, relating to screening coarser parts of excavated material from finer parts of such excavated material, comprising: at least one screen structured and arranged to screen such coarser parts of such excavated material from such finer parts of such excavated material; at least one vertical support, structured and arranged to vertically support such at least one screen above at least one ground surface, comprising at least one front wall having at least one in-side, at least one out-side, at least one left edge, at least one right edge, at least one bottom edge, and at least one top edge, at least one left side wall, comprising at least one left front end and at least one left back end, wherein such at least one left front end is fixedly connected to such at least one left edge, at least one right side wall, comprising at least one right front end and at least one right back end, wherein such at least one right front end is fixedly connected to such at least one right edge, wherein such at least one left side wall comprises at least one left substantially vertical bar member extending generally upward from such at least one left back end, and wherein such at least one right side wall comprises at least one right substantially vertical bar member extending generally upward from such at least one right back end; at least one angle adjuster structured and arranged to adjust the angle of such at least one screen relative to the at least one ground surface, comprising at least one front hinge structured and arranged to hingedly attach such at least one screen to such at least one front wall, at least one first left hinge structured and arranged to hingedly connect such at least one screen to such at least one left substantially vertical bar member, at least one second left hinge structured and arranged to hingedly connect such at least one left side wall to such at least one left substantially vertical bar member, at least one first right hinge structured and arranged to hingedly connect such at least one screen to such at least one right substantially vertical bar member, at least one second right hinge structured and arranged to hingedly connect such at least one right side wall to such at least one right substantially vertical bar member, at least one left length adjuster structured and arranged to adjust the length of such at least one left substantially vertical bar member, and at least one right length adjuster structured and arranged to adjust the length of such at least one right substantially vertical bar member. Moreover, it provides such a material screening system, wherein such at least one screen comprises: a plurality of screen members structured and arranged to block the passage of such coarser parts of such excavated material and to allow the passage of such finer parts of such excavated material; and at least one support frame structured and arranged to support such plurality of screen members. Additionally, it provides such a material screening system, wherein at least one of such plurality of screen members comprises at least one triangular cross-section, wherein the base of such at least one triangular cross-section is oriented adjacent such at least one support frame. Also, it provides such a material screening system, wherein such at least one support frame comprises at least one camber structured and arranged to compensate for at least one deflection generated within such at least one support frame under at least one operational load. In addition, it provides such a material screening system, further comprising at least one adjuster structured and arranged to adjust the spacing among such plurality of screen members, wherein adjustment of such plurality of screen members adjusts the size of such coarser parts of such excavated material blocked by such plurality of screen members, and such size of such finer parts passed by such plurality of screen members. And, it provides such a material screening system, wherein such at least one support frame comprises at least one secondary screen mount structured and arranged to removably mount at least one secondary screen. Further, it provides such a material screening system, further comprising such at least one secondary screen, wherein such at least one secondary screen comprises at least one woven wire screen. Even further, it provides such a material screening system, wherein such at least one left length adjuster comprises at least one left inner telescoping bar and at least one left outer telescoping sleeve; and such at least one right length adjuster comprises at least one right inner telescoping bar and at least one right outer telescoping sleeve. Moreover, it provides such a material screening system, wherein such at least one left inner telescoping bar is hingedly connected to such at least one left back end; such at least one left outer telescoping sleeve is hingedly connected to such at least one screen; such at least one right inner telescoping bar is hingedly connected to such at least one right back end; and such at least one right outer telescoping sleeve is hingedly connected to such at least one screen. Additionally, it provides such a material screening system, further comprising at least one left length selector structured and arranged to selectably fix the relative positions of such at least one left inner telescoping bar and such at least one left outer telescoping sleeve; and at least one right length selector structured and arranged to selectably fix the relative positions of such at least one right inner telescoping bar and such at least one right outer telescoping sleeve. Also, it provides such a material screening system, wherein such at least one left length selector comprises at least one pin-hole through such at least one left inner telescoping bar; and at least one pin structured and arranged to pierce such at least one pin-hole and to support at least one end of such at least one left outer telescoping sleeve; and such at least one right length selector comprises at least one pin-hole through such at least one right inner telescoping bar; and at least one pin structured and arranged to pierce such at least one pin-hole and to support at least one end of such at least one right outer telescoping sleeve. In addition, it provides such a material screening system, wherein such at least one angle adjuster is structured and arranged to adjust the angle of such at least one screen between about horizontal and past vertical, relative to the at least one ground surface. And, it provides such a material screening system, wherein such at least one angle adjuster comprises at least one positional retainer structured and arranged to firmly retain such at least one screen in about a horizontal position during transport.

In accordance with another preferred embodiment hereof, this invention provides a material screening system, relating to screening coarser parts of excavated material from finer parts of such excavated material, comprising: at least one screen structured and arranged to screen such coarser parts of such excavated material from such finer parts of such excavated material; at least one support, structured and arranged to support such at least one screen above at least one ground surface, comprising at least one front wall having at least one in-side, at least one out-side, at least one left edge, at least one right edge, at least one bottom edge, and at least one top edge; at least one left side wall, comprising at least one left front end and at least one left back end, wherein such at least one left front end is fixedly connected to such at least one left edge; at least one right side wall, comprising at least one right front end and at least one right back end, wherein such at least one right front end is fixedly connected to such at least one right edge, wherein such at least one left side wall and such at least one right side wall are substantially parallel; wherein such at least one left side wall comprises at least one left bar member extending generally upward from such at least one left back end; and wherein such at least one right side wall comprises at least one right bar member extending generally upward from such at least one right back end; wherein such at least one left side wall comprises at least one left diagonal cross-brace member structured and arranged to provide diagonal cross-brace support between such at least one front wall and such at least one left bar member; wherein such at least one right side wall comprises at least one right diagonal cross-brace member structured and arranged to provide diagonal cross-brace support between such at least one front wall and such at least one right bar member; wherein such at least one screen is attached to such at least one support; at least one angle adjuster structured and arranged to adjust the angle of such at least one screen relative to the at least one ground surface; wherein such at least one screen is hingedly attached to such at least one top edge of such at least one front wall. Further, it provides such a material screening system, wherein such at least one screen comprises a plurality of screen members structured and arranged to block the passage of such coarser parts of such excavated material and to allow passage of such finer parts of such excavated material, and at least one support frame structured and arranged to support such plurality of screen members; and wherein the spacing among such plurality of screen members is adjustable.

In accordance with a preferred embodiment hereof, this invention provides a material screening system, related screening coarser parts of excavated material from finer parts of such excavated material, comprising: at least one screen structured and arranged to screen such coarser parts of such excavated material from such finer parts of such excavated material; at least one vertical support, structured and arranged to vertically support such at least one screen above at least one ground surface, comprising at least one front wall having at least one in-side, at least one out-side, at least one left edge, at least one right edge, at least one bottom edge, and at least one top edge; at least one left side wall, comprising at least one left front end and at least one left back end, wherein such at least one left front end is fixedly connected to such at least one left edge; at least one right side wall, comprising at least one right front end and at least one right back end, wherein such at least one right front end is fixedly connected to such at least one right edge, wherein such at least one left side wall and such at least one right side wall are substantially parallel; wherein such at least one left side wall comprises at least one left substantially vertical bar member extending generally upward from such at least one left back end; and wherein such at least one right side wall comprises at least one right substantially vertical bar member extending generally upward from such at least one right back end; wherein such at least one left side wall comprises at least one left diagonal cross-brace member structured and arranged to provide diagonal cross-brace support between such at least one front wall and such at least one left substantially vertical bar member; wherein such at least one right side wall comprises at least one right diagonal cross-brace member structured and arranged to provide diagonal cross-brace support between such at least one front wall and such at least one right substantially vertical bar member; wherein such at least one screen is attached to such at least one left substantially vertical bar member, at least one right substantially vertical bar member, and such at least one front wall.

Moreover, it provides such a material screening system, wherein such at least one screen comprises: a plurality of screen members structured and arranged to block the passage of such coarser parts of such excavated material and to allow the passage of such finer parts of such excavated material; and at least one support frame structured and arranged to support such plurality of screen members. Additionally, it provides such a material screening system, wherein such at least one support frame comprises at least one camber structured and arranged to compensate for at least one deflection generated within such at least one support frame under at least one operational load. Also, it provides such a material screening system, further comprising at least one adjuster structured and arranged to adjust the spacing among such plurality of screen members, wherein adjustment of such plurality of screen members adjusts the size of such coarser parts of such excavated material blocked by such plurality of screen members, and such size of such finer parts passed by such plurality of screen members.

In addition, it provides such a material screening system, wherein at least one of such plurality of screen members comprises at least one triangular cross-section, wherein the base of such at least one triangular cross-section is oriented adjacent such at least one support frame. And, it provides such a material screening system, wherein: such at least one support frame comprises at least one secondary screen mount structured and arranged to removably mount at least one secondary woven wire screen. Further, it provides such a material screening system, further comprising: such at least one secondary woven wire screen; wherein such at least one secondary woven wire screen comprises at least one woven wire vibrator deck screen. Even further, it provides such a material screening system, further comprising at least one angle adjuster structured and arranged to adjust the angle of such at least one screen relative to the at least one ground surface.

Moreover, it provides such a material screening system, wherein such at least one left substantially vertical bar member comprises at least one left angle adjuster structured and arranged to adjust the angle of such at least one left substantially vertical bar member relative to the at least one ground surface; and such at least one right substantially vertical bar member comprises at least one right angle adjuster structured and arranged to adjust the angle of such at least one right substantially vertical bar member relative to the at least one ground surface. Additionally, it provides such a material screening system, wherein such at least one left angle adjuster comprises at least one left length adjuster structured and arranged to adjust the length of such at least one left substantially vertical bar member; and such at least one right angle adjuster comprises at least one right length adjuster structured and arranged to adjust the length of such at least one right substantially vertical bar member.

Also, it provides such a material screening system, wherein such at least one left length adjuster comprises at least one left inner telescoping bar and at least one left outer telescoping sleeve; and such at least one right length adjuster comprises at least one right inner telescoping bar and at least one right outer telescoping sleeve. In addition, it provides such a material screening system, further comprising at least one left length selector structured and arranged to selectably fix the relative positions of such at least one left inner telescoping bar and such at least one left outer telescoping sleeve; and at least one right length selector structured and arranged to selectably fix the relative positions of such at least one right inner telescoping bar and such at least one right outer telescoping sleeve. And, it provides such a material screening system, wherein such at least one left inner telescoping bar is hingedly connected to such at least one left back end; such at least one left outer telescoping sleeve is hingedly connected to such at least one screen; and such at least one right inner telescoping bar is hingedly connected to such at least one right back end; and such at least one right outer telescoping sleeve is hingedly connected to such at least one screen.

Further, it provides such a material screening system, wherein such at least one left length selector comprises at least one pin-hole through such at least one left inner telescoping bar; and at least one pin structured and arranged to pierce such at least one pin-hole and to support at least one end of such at least one left outer telescoping sleeve; and such at least one right length selector comprises at least one pin-hole through such at least one right inner telescoping bar; and at least one pin structured and arranged to pierce such at least one pin-hole and to support at least one end of such at least one right outer telescoping sleeve. Even further, it provides such a material screening system, wherein such at least one screen is hingedly attached to such at least one top edge of such at least one front wall.

Moreover, it provides such a material screening system, wherein such at least one angle adjuster is structured and arranged to adjust the angle of such at least one screen between about horizontal and past vertical, relative to the at least one ground surface. Additionally, it provides such a material screening system, wherein such at least one angle adjuster comprises at least one positional retainer structured and arranged to firmly retain such at least one screen in about a horizontal position during transport.

In accordance with another preferred embodiment hereof, this invention provides a material screening system, related screening coarser parts of excavated material from finer parts of such excavated material, comprising: at least one screen structured and arranged to screen such coarser parts of such excavated material from such finer parts of such excavated material; at least one vertical support, structured and arranged to vertically support such at least one screen above at least one ground surface, comprising at least one front wall having at least one in-side, at least one out-side, at least one left edge, at least one right edge, at least one bottom edge, and at least one top edge; at least one left side wall, comprising at least one left front end and at least one left back end, wherein such at least one left front end is fixedly connected to such at least one left edge; at least one right side wall, comprising at least one right front end and at least one right back end, wherein such at least one right front end is fixedly connected to such at least one right edge, wherein such at least one left side wall comprises at least one left substantially vertical bar member extending generally upward from such at least one left back end; and wherein such at least one right side wall comprises at least one right substantially vertical bar member extending generally upward from such at least one right back end; at least one angle adjuster structured and arranged to adjust the angle of such at least one screen relative to the at least one ground surface, comprising at least one front hinge structured and arranged to hingedly attach such at least one screen to such at least one front wall; at least one first left hinge structured and arranged to hingedly connect such at least one screen to such at least one at least one left substantially vertical bar member; at least one second left hinge structured and arranged to hingedly connect such at least one left side wall to such at least one at least one left substantially vertical bar member; at least one first right hinge structured and arranged to hingedly connect such at least one screen to such at least one right substantially vertical bar member; at least one second right hinge structured and arranged to hingedly connect such at least one right side wall to such at least one right substantially vertical bar member; at least one left length adjuster structured and arranged to adjust the length of such at least one left substantially vertical bar member; and at least one right length adjuster structured and arranged to adjust the length of such at least one right substantially vertical bar member.

Also, it provides such a material screening system, wherein such at least one screen comprises: a plurality of screen members structured and arranged to block the passage of such coarser parts of such excavated material and to allow the passage of such finer parts of such excavated material; and at least one support frame structured and arranged to support such plurality of screen members. In addition, it provides such a material screening system, wherein at least one of such plurality of screen members comprises at least one triangular cross-section, wherein the base of such at least one triangular cross-section is oriented adjacent such at least one support frame. And, it provides such a material screening system, wherein such at least one support frame comprises at least one camber structured and arranged to compensate for at least one deflection generated within such at least one support frame under at least one operational load.

Further, it provides such a material screening system, further comprising at least one adjuster structured and arranged to adjust the spacing among such plurality of screen members, wherein adjustment of such plurality of screen members adjusts the size of such coarser parts of such excavated material blocked by such plurality of screen members, and such size of such finer parts passed by such plurality of screen members. Even further, it provides such a material screening system, wherein: such at least one support frame comprises at least one secondary screen mount structured and arranged to removably mount at least one secondary woven wire screen. Even further, it provides such a material screening system, further comprising: such at least one secondary woven wire screen; wherein such at least one secondary woven wire screen comprises at least one woven wire vibrator deck screen.

Even further, it provides such a material screening system, wherein such at least one left length adjuster comprises at least one left inner telescoping bar and at least one left outer telescoping sleeve; and such at least one right length adjuster comprises at least one right inner telescoping bar and at least one right outer telescoping sleeve. Even further, it provides such a material screening system, wherein such at least one left inner telescoping bar is hingedly connected to such at least one left back end; such at least one left outer telescoping sleeve is hingedly connected to such at least one screen; such at least one right inner telescoping bar is hingedly connected to such at least one right back end; and such at least one right outer telescoping sleeve is hingedly connected to such at least one screen.

Even further, it provides such a material screening system, further comprising at least one left length selector structured and arranged to selectably fix the relative positions of such at least one left inner telescoping bar and such at least one left outer telescoping sleeve; and at least one right length selector structured and arranged to selectably fix the relative positions of such at least one right inner telescoping bar and such at least one right outer telescoping sleeve. Even further, it provides such a material screening system, wherein such at least one left length selector comprises at least one pin-hole through such at least one left inner telescoping bar; and at least one pin structured and arranged to pierce such at least one pin-hole and to support at least one end of such at least one left outer telescoping sleeve; and such at least one right length selector comprises at least one pin-hole through such at least one right inner telescoping bar; and at least one pin structured and arranged to pierce such at least one pin-hole and to support at least one end of such at least one right outer telescoping sleeve.

Even further, it provides such a material screening system, wherein such at least one angle adjuster is structured and arranged to adjust the angle of such at least one screen between about horizontal and past vertical, relative to the at least one ground surface. Even further, it provides such a material screening system, wherein such at least one angle adjuster comprises at least one positional retainer structured and arranged to firmly retain such at least one screen in about a horizontal position during transport.

In accordance with another preferred embodiment hereof, this invention provides a method, related to the efficient storage and transport of grizzly-type material screeners, comprising the steps of: configuring at least one screen surface of at least one first grizzly-type material screener to comprise a substantially horizontal screen position; and supportably stacking at least one second grizzly-type material screener on such at least one first grizzly-type material screener; wherein such at least one screen surface is structured and arranged to screen coarser parts of excavated material from finer parts of such excavated material; and wherein such at least one screen surface is configurable to at least one non-horizontal position.

In addition, this invention provides each and every novel feature, element, combination, step and/or method disclosed or suggested by this patent application.

DETAILED DESCRIPTION OF THE BEST MODES AND PREFERRED EMBODIMENTS OF THE INVENTION

Figure 1A:
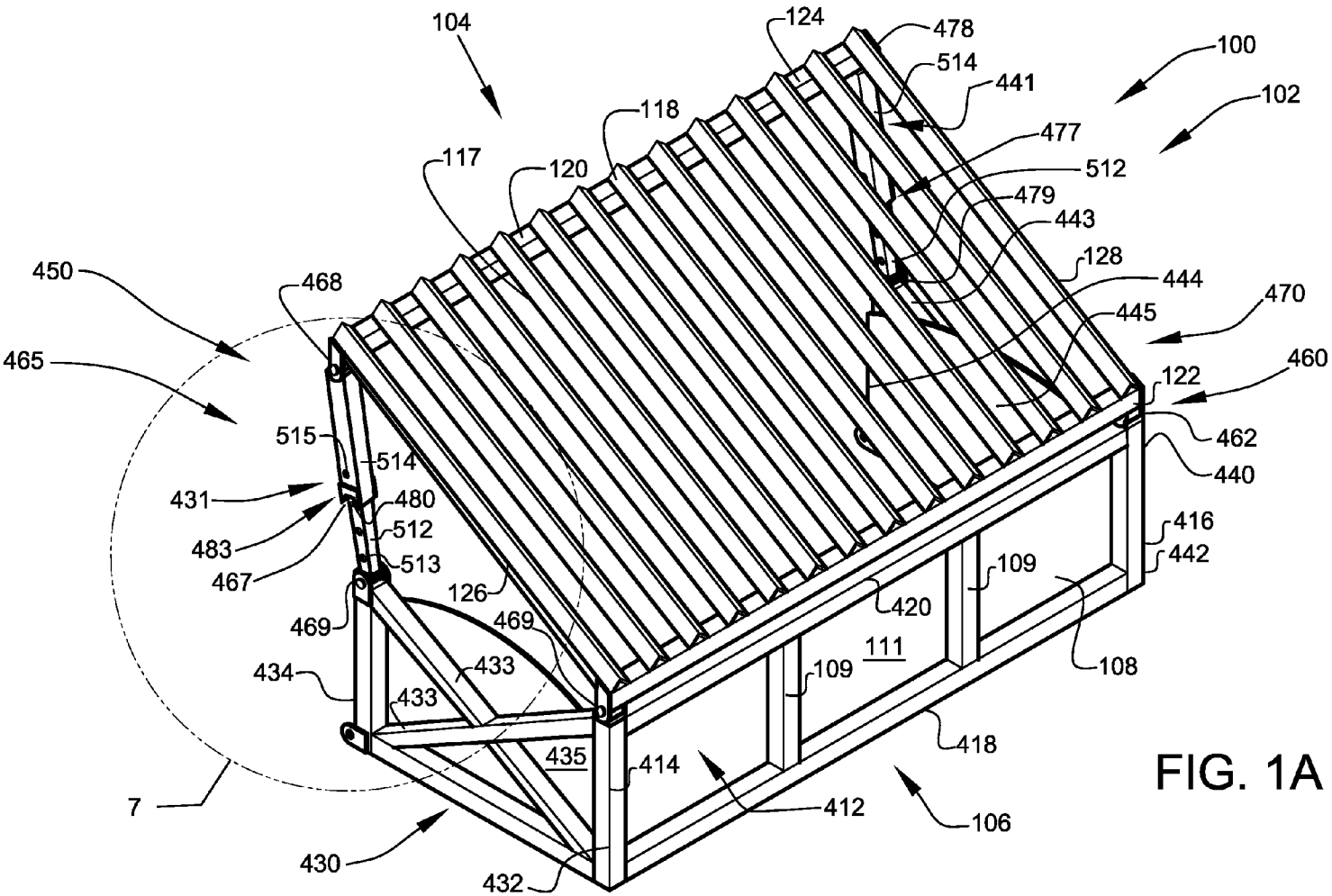
FIG. 1A shows a perspective view illustrating a material screener, of a material screening system, according to a preferred embodiment of the present invention.

FIG. 1A shows a perspective view illustrating material screener 102, of material screening system 100, according to a preferred embodiment of the present invention. Material screening system 100 preferably comprises a system of embodiments adapted to provide improved field processing of ore, rock, and soil. More particularly, material screening system 100 relates to providing a reconfigurable system for screening of rocks, rubble, gravel, and debris from soil based on material size. In addition, the described embodiments of material screening system 100 provide improvements related to efficient storage and transportation.

Figure 2:
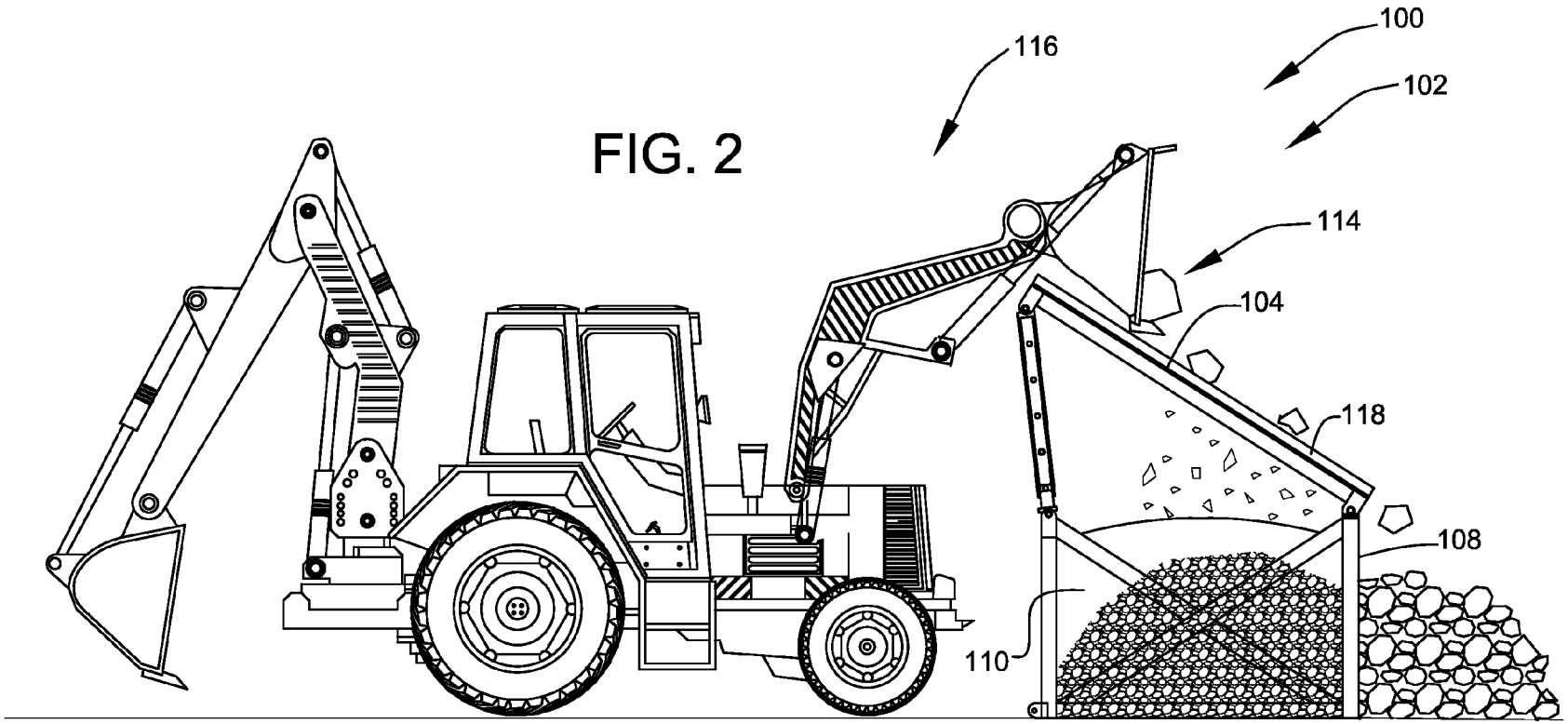
FIG. 2 shows a side view of the material screener in use, according to a preferred embodiment and method of use of the present invention.

Preferably, material screening system 100 comprises material screener 102, as shown. Preferably, material screener 102 comprises at least one screen assembly 104 and base support 106, as shown. Preferably, screen assembly 104 screens coarser parts of excavated earth material from finer parts of such excavated material, as best illustrated in FIG. 2, as shown.

Figure 6:
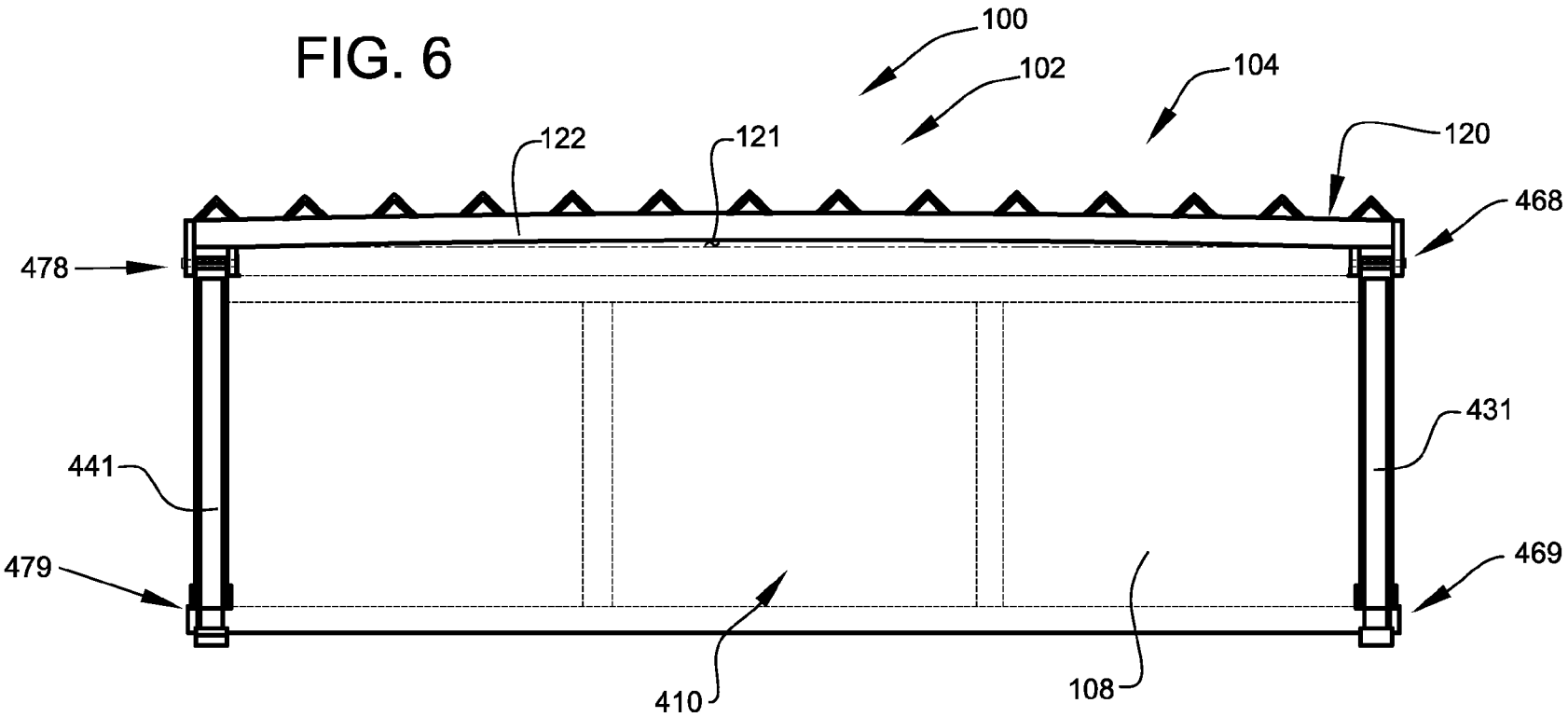
FIG. 6 shows a back view illustrating the material screener in the compact stowed configuration according to FIG. 1B.

Preferably, base support 106 supports screen assembly 104 above the supporting ground surface, as shown. Preferably, base support 106 comprises front wall 108, left side wall 430, and right side wall 440, as shown. Preferably, front wall 108, left side wall 430, and right side wall 440 form a three-sided box, as shown. Preferably, front wall 108 comprises at least one in-side 410 (as shown in FIG. 6), at least one out-side 412, at least one left edge 414, at least one right edge 416, at least one bottom edge 418, and at least one top edge 420, as shown. Preferably, left side wall 430 comprises at least one left front end 432 and at least one left back end 434, as shown. Preferably, left front end 432 is fixedly connected to left edge 414, as shown. Preferably, right side wall 440 comprises right front end 442 and right back end 444, as shown. Preferably, right front end 442 is fixedly connected to right edge 416, as shown. Preferably, left side wall 430 and right side wall 440 are substantially parallel, as shown (at least embodying herein wherein such at least one left side wall and such at least one right side wall are substantially parallel). Upon reading the teachings of this specification, those skilled in the art will now understand that, under appropriate circumstances, considering such issues as advances in technology, user preference, intended use, etc., other base supports, such as curved supports, four-sided supports, five-sided supports, etc., may suffice.

Preferably, base support 106 is about twelve feet long, about seven feet wide, and about four feet tall. Preferably, base support 106 is constructed primarily with four-inch wide square steel tubes. Upon reading the teachings of this specification, those skilled in the art will now understand that, under appropriate circumstances, considering such issues as advances in technology, user preference, etc., other sizes, such as five feet long, twenty feet long, ten feet tall, etc., may suffice.

Preferably, left side wall 430 comprises left vertical bar 431 (at least embodying herein wherein such at least one left side wall comprises at least one left substantially vertical bar member extending generally upward from such at least one left back end) extending generally upward from left back end 434, as shown. Preferably, right side wall 440 comprises right vertical bar 441 (at least embodying herein wherein such at least one right side wall comprises at least one right substantially vertical bar member extending generally upward from such at least one right back end) extending generally upward from right back end 444, as shown.

Preferably, left side wall 430 comprises at least one left diagonal cross-brace 433, as shown. Preferably, left diagonal cross-brace 433 (at least embodying herein wherein such at least one left side wall comprises at least one left diagonal cross-brace member structured and arranged to provide diagonal cross-brace support between such at least one front wall and such at least one left substantially vertical bar member) provides diagonal cross-brace support between front wall 108 and left vertical bar 431, as shown. Preferably, right side wall 440 comprises at least one right diagonal cross-brace 443, as shown. Preferably, right diagonal cross-brace 443 (at least embodying herein wherein such at least one right side wall comprises at least one right diagonal cross-brace member structured and arranged to provide diagonal cross-brace support between such at least one front wall and such at least one right substantially vertical bar member) provides diagonal cross-brace support between front wall 108 and right vertical bar 441, as shown. Preferably, for the purposes of the present patent application the term "diagonal" refers to an angle between about fifteen degrees and about seventy-five degrees from horizontal (the ground).

Preferably, front wall 108 comprises at least one support strut 109 between bottom edge 418 and top edge 420, as shown. Preferably, front wall 108 comprises front shield 111, as shown. Preferably, front shield 111 prevents material from falling out of base support 106 through front wall 108, as shown. Preferably, front shield 111 is fixedly attached adjacent in-side 410, as shown. More preferably, front shield 111 is fixedly attached adjacent out-side 412. Preferably, front shield 111 extends slightly above front wall 108, in order to help prevent rocks from going between base support 106 and screen assembly 104. Preferably, front shield 111 is notched to accommodate front hinge 460.

Preferably, left side wall 430 comprises at least one left shield 435, as shown. Preferably, left shield 435 prevents material from falling out of base support 106 through left side wall 430, as shown. Preferably, right side wall 440 comprises at least one right shield 445, as shown. Preferably, right shield 445 prevents material from falling out of base support 106 through right side wall 440, as shown. Preferably, left shield 435, right shield 445, and front shield 111 comprise sheet metal, preferably one-eighth inch thick sheet steel, as shown. Preferably, left shield 435, right shield 445, and front shield 111 are welded in place.

Preferably, screen assembly 104 is attached to left vertical bar 431, right vertical bar 441, and front wall 108, as shown (at least embodying herein wherein such at least one screen is attached to such at least one left substantially vertical bar member, at least one right substantially vertical bar member, and such at least one front wall). More preferably, screen assembly 104 is attached to the top of left vertical bar 431, to the top of right vertical bar 441, and to top edge 420 of front wall 108, as shown.

Preferably, screen assembly 104 comprises peripheral frame 120, as shown. Preferably, peripheral frame 120 is constructed from welded tube members, as shown. Preferably, peripheral frame 120 supports a plurality of spaced-apart screen members 118, as shown. Preferably, screen members 118 block the passage of coarser parts of excavated material and allow the passage of finer parts of excavated material, as shown in FIG. 2. Preferably, peripheral frame 120 comprises front support 122, rear support 124, left support 126, and right support 128, as shown.

Preferably, screen members 118 (at least embodying herein a plurality of screen members structured and arranged to block the passage of such coarser parts of such excavated material and to allow the passage of such finer parts of such excavated material) comprise structural angles, preferably structural steel angles having equal length legs, as shown. The use of an optional mid-support member, preferably spanning across peripheral frame, allows the use of lighter screen members 118. Most preferably, the mid-support member is omitted in favor of the use of heavier screen members 118 (preferably one-half inch thick angles), as shown. Preferably, screen members 118 have a triangular cross-section, with the base of the triangle facing peripheral frame 120 (at least embodying herein at least one support frame structured and arranged to support such plurality of screen members) and the apex of the triangle facing upward toward the incoming load of material to be sorted, as shown. Preferably, the narrowest point between two screen members 118 (at least embodying herein wherein at least one of such plurality of screen members comprises at least one triangular cross-section, wherein the base of such at least one triangular cross-section is oriented adjacent such at least one support frame) is the space between the thin edges 117 of the screen members 118, as shown. If rocks become trapped in this space, they are only held by the thin edges of screen members 118, so the rocks are easy to remove by hitting the rocks with a hammer from underneath screen assembly 104. Upon reading the teachings of this specification, those skilled in the art will now understand that, under appropriate circumstances, considering such issues as advances in technology, user preference, etc., other screen members, such as round bars, square bars, axially rotating bars, etc., may suffice.

Preferably, left side wall 430 (at least embodying herein at least one left side wall, comprising at least one left front end and at least one left back end, wherein such at least one left front end is fixedly connected to such at least one left edge) comprises left vertical bar 431 extending generally upward from left back end 434, as shown. Preferably, right side wall 440 (at least embodying herein at least one right side wall, comprising at least one right front end and at least one right back end, wherein such at least one right front end is fixedly connected to such at least one right edge) comprises right vertical bar 441 extending generally upward from right back end 444, as shown. Upon reading the teachings of this specification, those skilled in the art will now understand that, under appropriate circumstances, considering such issues as advances in technology, user preference, etc., other arrangements, such as the vertical bars rising from another point on the sidewall, the vertical bars being supported by the ground, etc., may suffice.

Preferably, material screener 102 comprises at least one angle adjuster 450, as shown. Preferably, angle adjuster 450 adjusts the angle of screen assembly 104 relative to the ground surface, as shown. Preferably, angle adjuster 450 (at least embodying herein at least one angle adjuster structured and arranged to adjust the angle of such at least one screen relative to the at least one ground surface) comprises front hinge 460, left angle adjuster 465, and right angle adjuster 470, as shown. Upon reading the teachings of this specification, those skilled in the art will now understand that, under appropriate circumstances, considering such issues as advances in technology, user preference, etc., other angle adjusters, such as ratchet systems, other telescoping arrangements including non-incremental sliding systems, modular length-adjustable sections, motorized angle adjusters, hydraulic angle adjusters, etc., may suffice.

Preferably, front hinge 460 hingedly connects front wall 108 and screen assembly 104, as shown. More preferably, front hinge 460 hingedly connects front support 122 of screen assembly 104 to top edge 420 of front wall 108, as shown. Preferably, front hinge 460 comprises left front hinge 461 and right front hinge 462, as shown. Upon reading the teachings of this specification, those skilled in the art will now understand that, under appropriate circumstances, considering such issues as advances in technology, user preference, etc., other front hinge arrangements, such as other types of hinges, other numbers of hinges, other hinge or pivot point placements, etc., may suffice.

Preferably, left angle adjuster 465 comprises left vertical bar 431, as shown. Preferably, left angle adjuster 465 adjusts the angle of left vertical bar 431 relative to the ground surface, as shown. Preferably, right vertical bar 441 comprises right angle adjuster 470, as shown. Preferably, right angle adjuster 470 adjusts the angle of right vertical bar 441 relative to the ground surface, as shown. Preferably, left angle adjuster 465 (at least embodying herein wherein such at least one left substantially vertical bar member comprises at least one left angle adjuster structured and arranged to adjust the angle of such at least one left substantially vertical bar member relative to the at least one ground surface) comprises left length adjuster 467, as shown. Preferably, left length adjuster 467 (at least embodying herein wherein such at least one left angle adjuster comprises at least one left length adjuster structured and arranged to adjust the length of such at least one left substantially vertical bar member) adjusts the length of left vertical bar 431, as shown. Preferably, left length adjuster 467 comprises inner telescoping rod 512 (comprising at least one adjustment aperture 513) and outer telescoping sleeve 514 (comprising at least one retainer aperture 515), as shown.

Preferably, right angle adjuster 475 (at least embodying herein wherein such at least one right substantially vertical bar member comprises at least one right angle adjuster structured and arranged to adjust the angle of such at least one right substantially vertical bar member relative to the at least one ground surface) comprises right length adjuster 477, as shown. Preferably, right length adjuster 477 (at least embodying herein wherein such at least one right angle adjuster comprises at least one right length adjuster structured and arranged to adjust the length of such at least one right substantially vertical bar member) adjusts the length of right vertical bar 441, as shown. Preferably, right length adjuster 477 comprises inner telescoping rod 512 (comprising at least one adjustment aperture 513) and outer telescoping sleeve 514 (comprising at least one retainer aperture 515), as shown. Upon reading the teachings of this specification, those skilled in the art will now understand that, under appropriate circumstances, considering such issues as advances in technology, user preference, etc., other vertical bar arrangements, such as other numbers of vertical bars, etc., may suffice.

Preferably, left angle adjuster 465 comprises top left hinge 468 and bottom left hinge 469, as shown. Preferably, top left hinge 468 (at least embodying herein at least one first left hinge structured and arranged to hingedly connect such at least one screen to such at least one at least one left substantially vertical bar member) is adjacent screen assembly 104, as shown. Preferably, bottom left hinge 469 (at least embodying herein at least one second left hinge structured and arranged to hingedly connect such at least one left side wall to such at least one at least one left substantially vertical bar member) is adjacent base support 106, as shown. Preferably, top left hinge 468 and bottom left hinge 469 both operate parallel to front hinge 460, as shown.

Preferably, right angle adjuster 475 comprises top right hinge 478 and bottom right hinge 479, as shown. Preferably, top right hinge 478 (at least embodying herein at least one first right hinge structured and arranged to hingedly connect such at least one screen to such at least one right substantially vertical bar member) is adjacent screen assembly 104, as shown. Preferably, bottom right hinge 479 (at least embodying herein at least one second right hinge structured and arranged to hingedly connect such at least one right side wall to such at least one right substantially vertical bar member) is adjacent base support 106, as shown. Preferably, top right hinge 478 and bottom right hinge 479 both operate parallel to front hinge 460, as shown. Upon reading the teachings of this specification, those skilled in the art will now understand that, under appropriate circumstances, considering such issues as advances in technology, user preference, etc., other hinge arrangements, such as other types of hinges, other numbers of hinges, other hinge or pivot point placements, etc., may suffice.

Preferably, the simultaneous movement of front hinge 460 (at least embodying herein wherein such at least one screen is hingedly attached to such at least one top edge of such at least one front wall), top left hinge 468 (at least embodying herein wherein at least one left outer telescoping sleeve is hingedly connected to such at least one screen), bottom left hinge 469, top right hinge 478 (at least embodying herein wherein such at least one right outer telescoping sleeve is hingedly connected to such at least one screen), bottom right hinge 479, left length adjuster 467 (at least embodying herein wherein such at least one left length adjuster comprises at least one left inner telescoping bar and at least one left outer telescoping sleeve), and right length adjuster 477 (at least embodying herein wherein such at least one right length adjuster comprises at least one right inner telescoping bar and at least one right outer telescoping sleeve) permits screen assembly 104 to rotate about front hinge 460, as shown.

Preferably, as rear support 124 is raised, the angle between screen assembly 104 and base support 106 increases while left vertical bar 431 and right vertical bar 441 simultaneously lengthen and rotate, as shown in FIGS. 4A-4E, as shown. Preferably, as rear support 124 is lowered, the angle between screen assembly 104 and base support 106 decreases while left vertical bar 431 and right vertical bar 441 simultaneously shorten and rotate, as shown. Preferably, when the desired angle between screen assembly 104 and base support 106 is achieved, left vertical bar 431 and right vertical bar 441 are secured at that length and angle, as shown. Preferably, left vertical bar 431 and right vertical bar 441 are secured at the desired length with securer 483, as shown. Preferably, securer 483 (at least embodying herein at least one left length selector structured and arranged to selectably fix the relative positions of such at least one left inner telescoping bar and such at least one left outer telescoping sleeve; and at least embodying herein at least one right length selector structured and arranged to selectably fix the relative positions of such at least one right inner telescoping bar and such at least one right outer telescoping sleeve) comprises pin 480 (at least embodying herein at least one pin structured and arranged to pierce such at least one pin-hole and to support at least one end of such at least one left outer telescoping sleeve) through hole 513 (at least embodying herein wherein such at least one left length selector comprises at least one pin-hole through such at least one left inner telescoping bar; and at least embodying herein wherein such at least one right length selector comprises at least one pin-hole through such at least one right inner telescoping bar), as shown. Preferably, pins 480 are retained with cotter pins. Upon reading the teachings of this specification, those skilled in the art will now understand that, under appropriate circumstances, considering such issues as advances in technology, user preference, etc., other length-securing systems, such as clamps, screws, bolts, wedges, friction, hydraulic lifts, etc., may suffice.

Figure 1B:
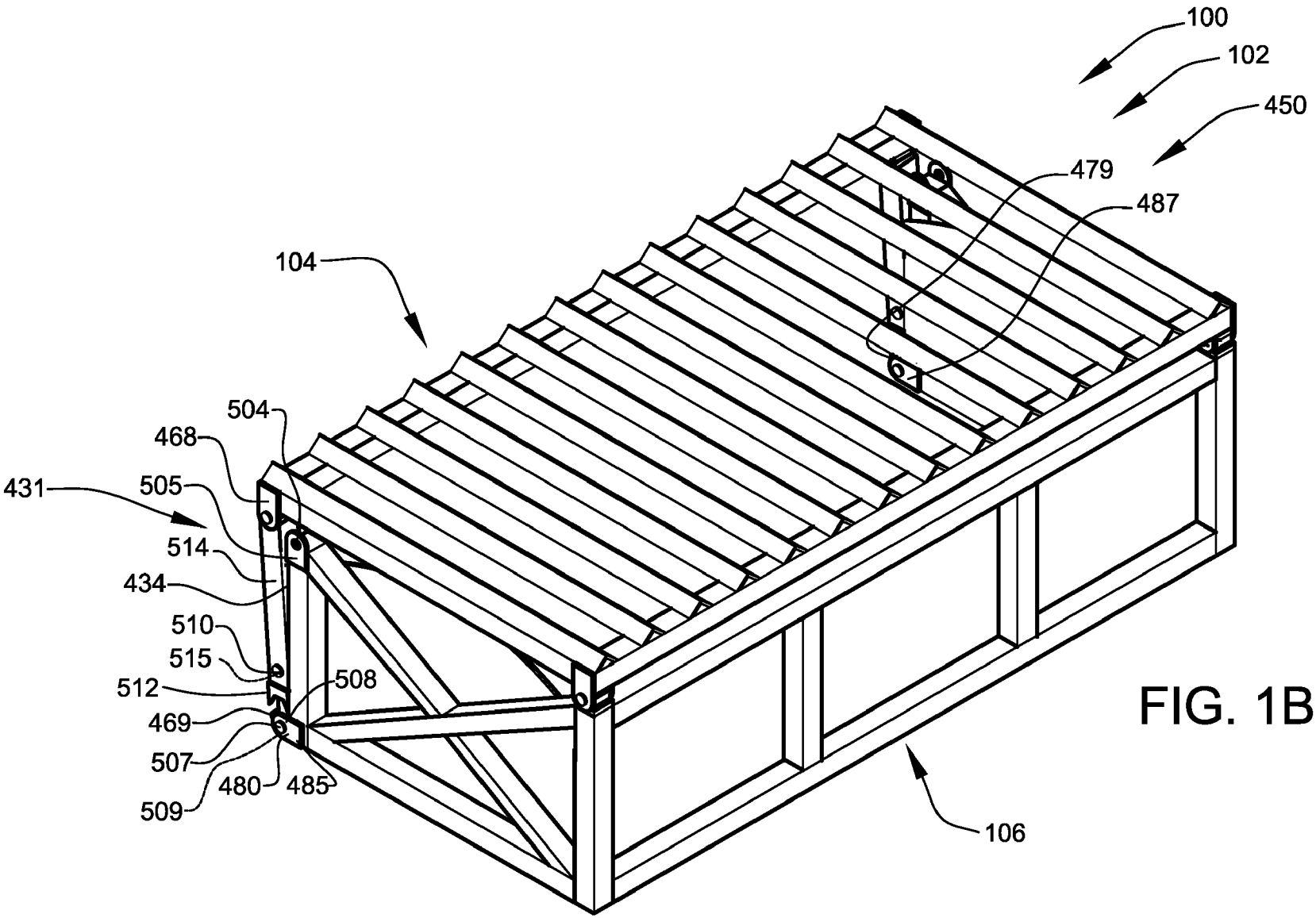
FIG. 1B shows a perspective view illustrating the material screener according to FIG. 1A configured for transportation and/or storage.

FIG. 1B shows a perspective view illustrating material screener 102 according to FIG. 1A configured for transportation and/or storage. Preferably, angle adjuster 450 comprises positional retainer 480, as shown. Preferably, positional retainer 480 firmly retains screen assembly 104 in about a horizontal position, preferably during transportation and/or storage of material screener 102. Preferably, positional retainer 480 (at least embodying herein wherein such at least one angle adjuster comprises at least one positional retainer structured and arranged to firmly retain such at least one screen in about a horizontal position during transport) comprises bottom left hinge 469, bottom right hinge 479, left retainer 485, and right retainer 487, as shown. Preferably, positional retainer 480 secures screen assembly 104 (at least embodying herein at least one screen structured and arranged to screen such coarser parts of such excavated material from such finer parts of such excavated material) in a substantially horizontal position, as shown.

Figure 8:
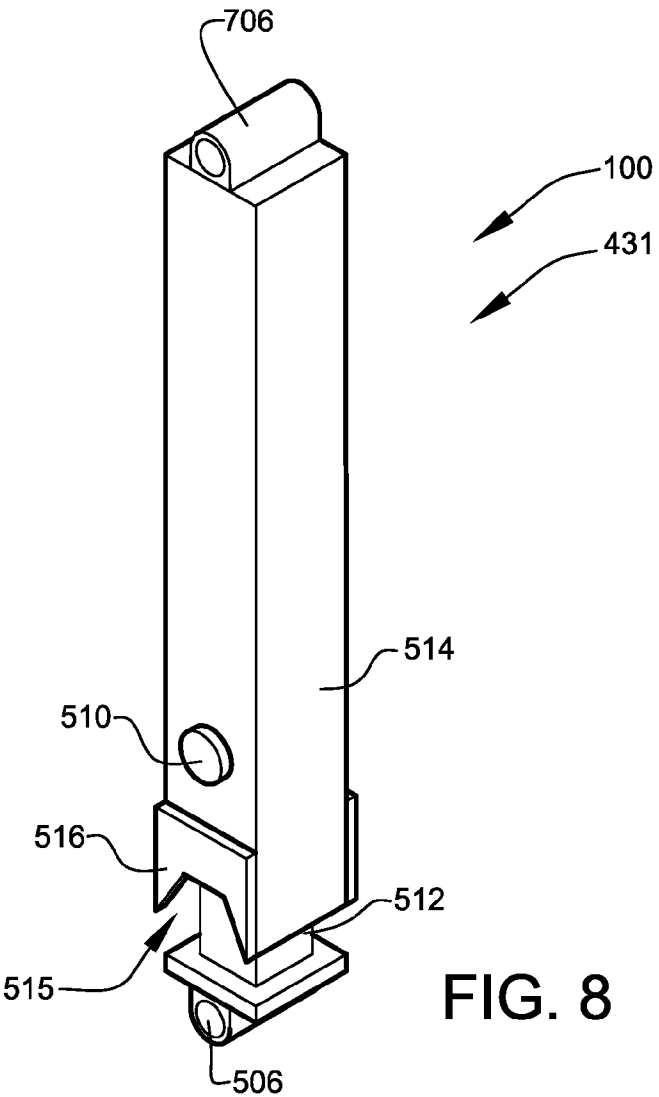
FIG. 8 shows a perspective view illustrating the left vertical bar according to FIG. 1A.

Preferably, bottom left hinge 469 (at least embodying herein wherein such at least one left inner telescoping bar is hingedly connected to such at least one left back end) comprises bracket 505, axle 506 (as shown in FIG. 8), and pin 507, as shown. Preferably, bracket 505 is fixedly attached to base support 106, as shown. Preferably, axle 506 is fixedly attached to the end of left vertical bar 431, as shown in FIG. 8. Preferably, bracket 505 comprises holes 504, as shown. Preferably, axle 506 is positioned in bracket 505 and pin 507 is put through holes 504 and axle 506 to hingedly attach left vertical bar 431 to base support 106, as shown. Preferably, bottom right hinge 479 (at least embodying herein wherein such at least one right inner telescoping bar is hingedly connected to such at least one right back end) is constructed substantially identically to bottom left hinge 469, as shown.

Preferably, left retainer 485 comprises bracket 508 with holes 509, as shown. Preferably, left retainer 485 is fixedly attached to left back end 434 at about ground level, directly below bottom left hinge 469, and parallel to bottom left hinge 469, as shown.

Preferably, pin 507 is removed from bracket 505, axle 506 is moved to bracket 509, and pin 507 is put through holes 509 and axle 506 to hingedly attach left vertical bar 431 to base support 106 (at least embodying herein at least one vertical support, structured and arranged to vertically support such at least one screen above at least one ground surface, comprising at least one front wall having at least one in-side, at least one out-side, at least one left edge, at least one right edge, at least one bottom edge, and at least one top edge), as shown. Preferably, left vertical bar 431 is locked at the correct length for this horizontal configuration prior to reconfiguring material screener 102, as shown by pin 510 through inner telescoping rod 512 (through an adjustment aperture 513) and outer telescoping sleeve 514 (through retainer aperture 515) of left vertical bar 431, as shown. Preferably, right retainer 487 is constructed substantially identically to left retainer 485, as shown. Upon reading the teachings of this specification, those skilled in the art will now understand that, under appropriate circumstances, considering such issues as advances in technology, user preference, etc., other positional retainers, such as clamps, screws, bolts, other retainer placement, etc., may suffice.

FIG. 2 shows a side view of material screener 102 in use, according to a preferred embodiment and method of use of the present invention. Preferably, excavated material 114 is dropped over screen assembly 104 of material screener 102, as shown. Typically, excavated material 114 is delivered by tractor 116, for example, a front-end loader, as shown. Preferably, large rocks and similar debris are blocked from passage through screen assembly 104 by screen members 118, as shown. Preferably, smaller material passes through screen assembly 104, to be deposited behind front wall 108, and between sidewalls 110, as shown. During use, screen assembly 104 is preferably maintained at an elevated angle, as shown, thus utilizing gravity to assist in clearing the screen of the larger rocks (which preferably slide down screen members 118 of screen assembly 104 to be deposited adjacent the outside of front wall 108), as shown.

Figure 3:
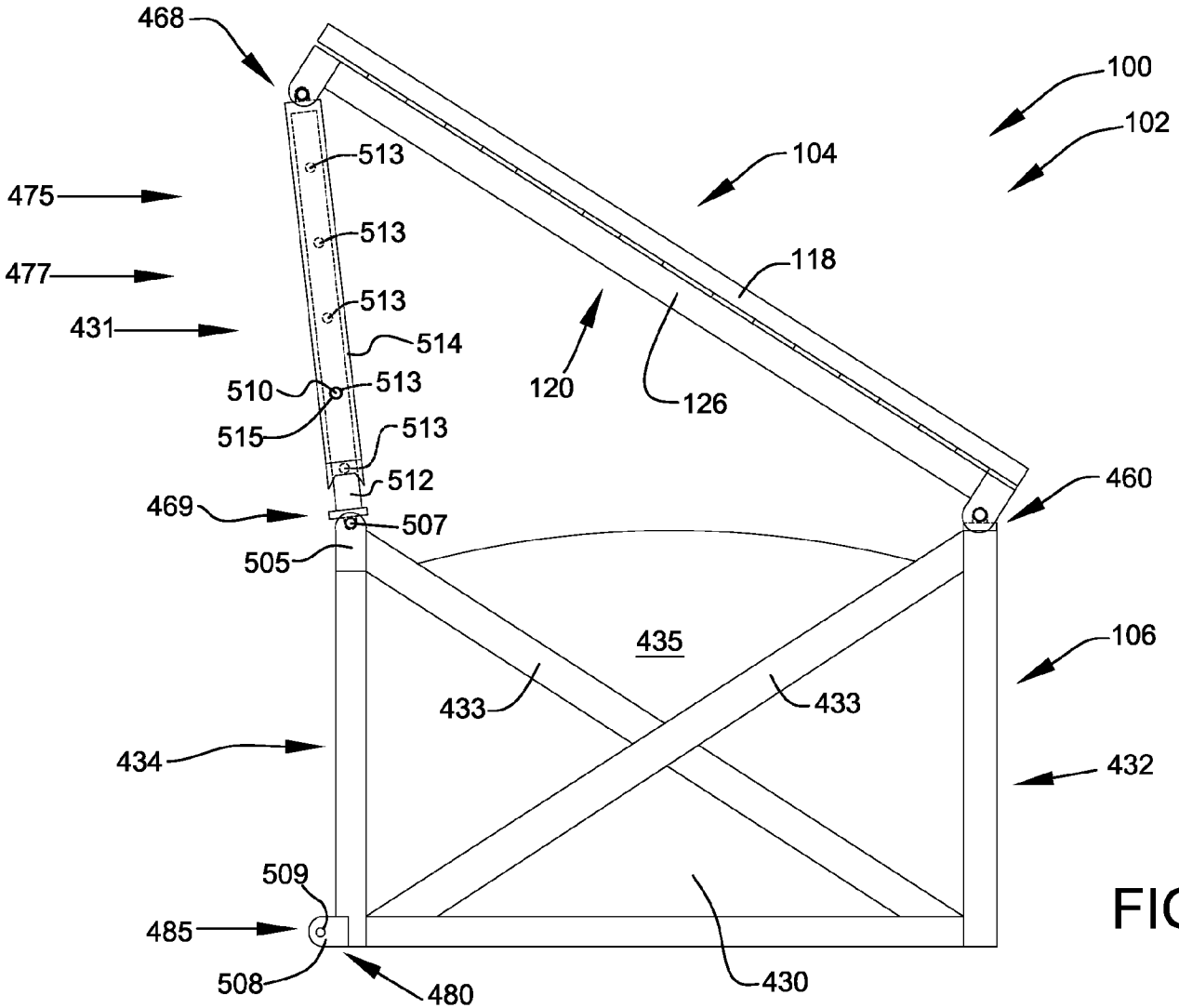
FIG. 3 shows a side view illustrating the material screener in a low angle operational configuration, according to the preferred embodiment of FIG. 1.
Figure 4C:
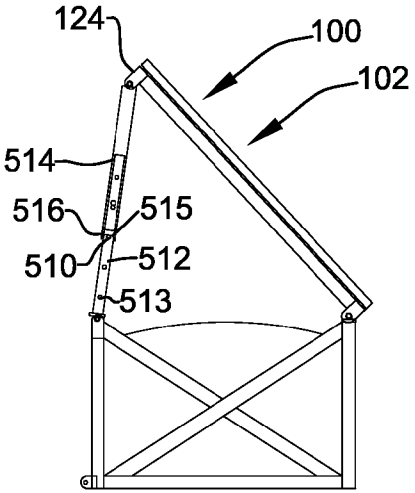
FIG. 4C shows a side view of the material screener in a third operational configuration, according to the preferred embodiment of FIG. 1.
Figure 4B:
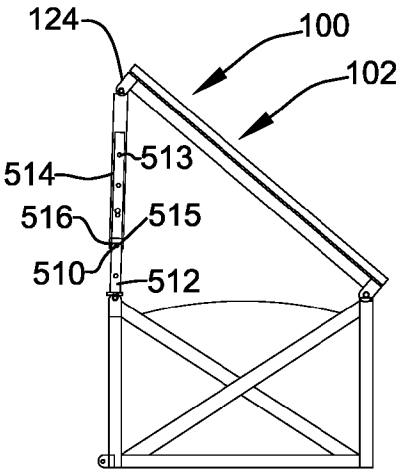
FIG. 4B shows a side view of the material screener in a second operational configuration, according to the preferred embodiment of FIG. 1.
Figure 4A:
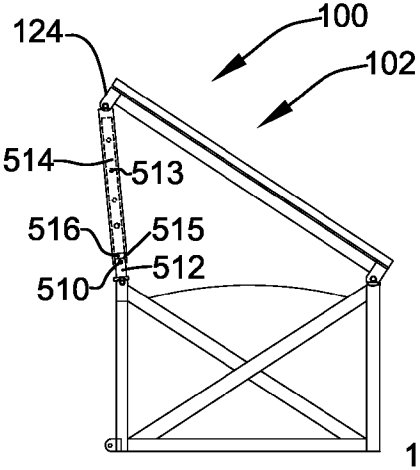
FIG. 4A shows a side view of the material screener in a first operational configuration, according to the preferred embodiment of FIG. 1.
Figure 4E:
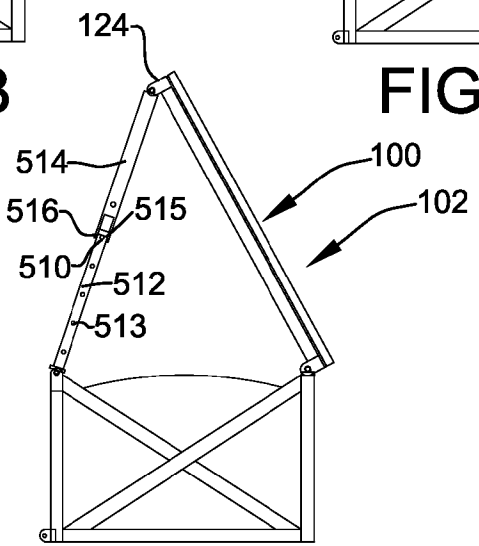
FIG. 4E shows a side view of the material screener in a fifth operational configuration, according to the preferred embodiment of FIG. 1.
Figure 4D:
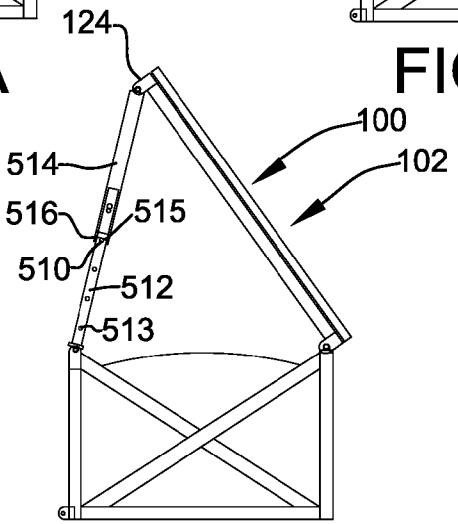
FIG. 4D shows a side view of the material screener in a fourth operational configuration, according to the preferred embodiment of FIG. 1.

FIG. 3 shows a side view illustrating material screener 102 in a low angle operational configuration, according to the preferred embodiment of FIG. 1.

Preferably, material screener 102 is structured and arranged to allow angular adjustments of screen assembly 104, as shown. Preferably, the angle adjusting arrangement of material screener 102 is adapted to adjust the angle of screen assembly 104 between about horizontal (as shown in FIG. 1B) and past vertical (to assist in clearing large material that sometimes lodges between screen members 118) (at least embodying herein wherein such at least one angle adjuster is structured and arranged to adjust the angle of such at least one screen between about horizontal and past vertical, relative to the at least one ground surface).

Preferably, left vertical bar 431 can be attached to either bracket 505 or bracket 508 when pin 510 is inserted through inner telescoping rod 512 (through an adjustment aperture 513) and through outer telescoping sleeve 514 (through retainer aperture 515) of left vertical bar 431, as shown. Preferably, retainer aperture 515 is used primarily for transportation and storage configurations.

FIGS. 4A-4E show side views of material screener 102, in various operational configurations, according to the preferred embodiment of FIG. 1. Preferably, rear support 124 is lifted (preferably with a front-end loader or other heavy equipment), which causes outer telescoping sleeve 514 to move vertically along inner telescoping rod 512, exposing adjustment apertures 513 along the way, as shown. Preferably, when the adjustment aperture 513 that corresponds to the desired height is uncovered, pin 510 is inserted into the adjustment aperture 513, as shown. Preferably, outer telescoping sleeve 514 is then lowered until notch 515 of outer telescoping sleeve 514 rests on pin 510, as shown. Preferably, notch 515 is structurally reinforced with notch plate 516, as shown. This novel system allows material screener 102 to be easily reconfigured by a single user. Upon reading the teachings of this specification, those skilled in the art will now understand that, under appropriate circumstances, considering such issues as advances in technology, user preference, etc., other arrangements, such as using the outer telescoping sleeve in the bottom section and using the inner telescoping rod in the top section, etc., may suffice.

Figure 5:
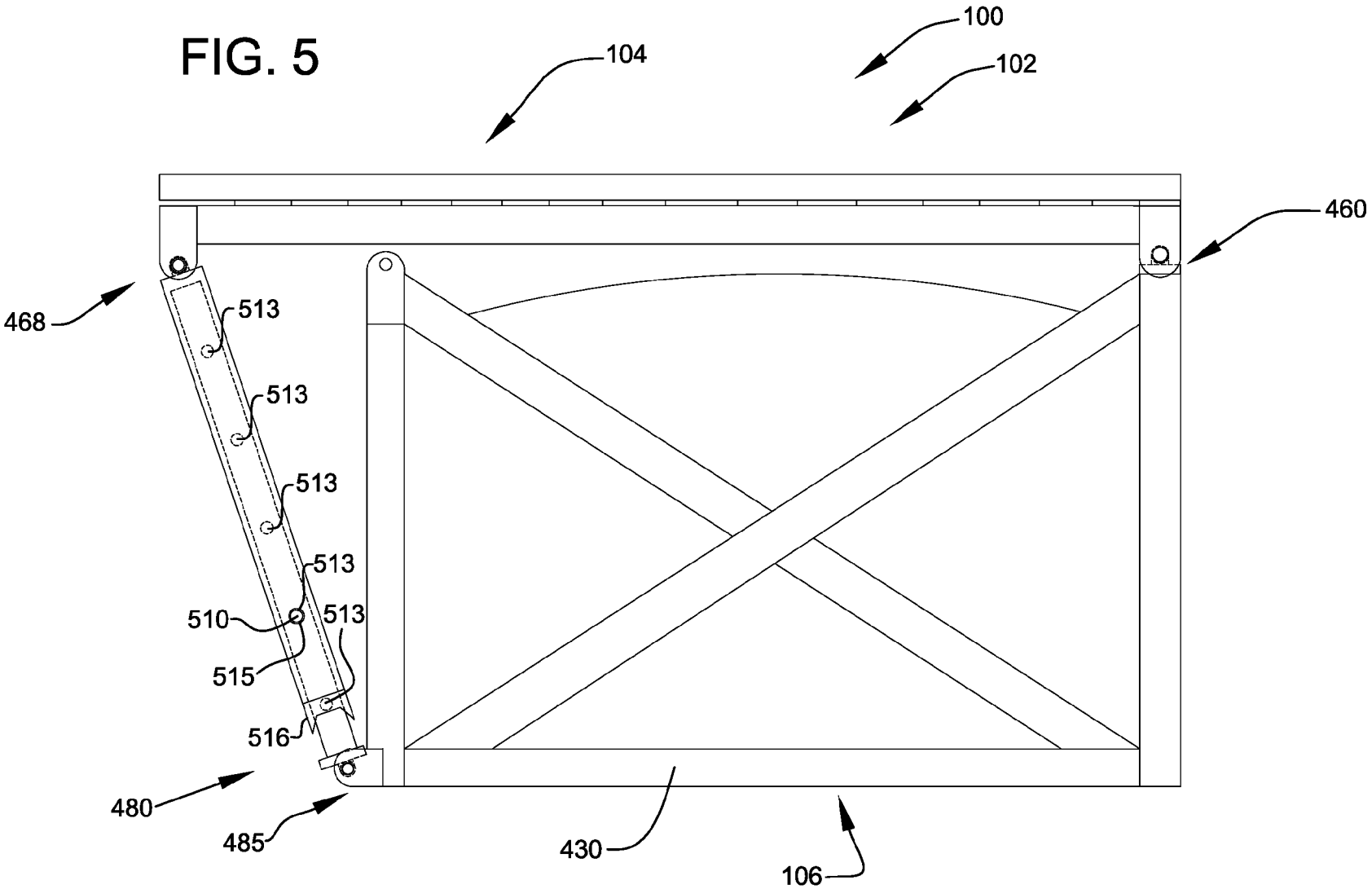
FIG. 5 shows a side view illustrating the material screener in the compact stowed configuration according to FIG. 1B.

FIG. 5 shows a side view illustrating material screener 102, in the compact stowed configuration according to FIG. 1B. Preferably, screen assembly 104 is stored fixed in a horizontal position in order to conserve space, as shown.

FIG. 6 shows a back view illustrating material screener 102, in the compact stowed configuration according to FIG. 1B. Preferably, the long span members of peripheral frame 120 are constructed with camber 121, as shown. Preferably, camber 121 (at least embodying herein wherein such at least one support frame comprises at least one camber structured and arranged to compensate for at least one deflection generated within such at least one support frame under at least one operational load) compensates for the structural deflection generated within peripheral frame 120 under operational load. Preferably, front support 122 is about twelve feet long with about a two inch camber. Preferably, rear support 124 is about twelve feet long with about a two inch camber. Upon reading the teachings of this specification, those skilled in the art will now understand that, under appropriate circumstances, considering such issues as advances in technology, user preference, etc., other arrangements, such as other camber depths, additional cambers on other structural members, etc., may suffice.

Figure 7:
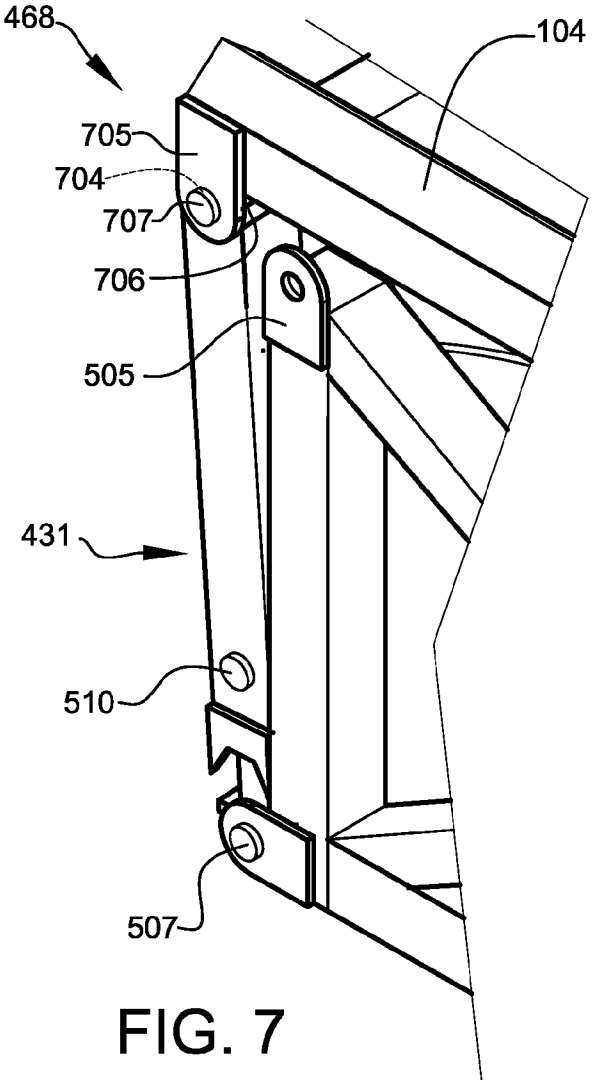
FIG. 7 shows a perspective view illustrating section 7 of FIG. 1A.

FIG. 7 shows a perspective view illustrating section 7 of FIG. 1A. Preferably, top left hinge 468 is adjacent screen assembly 104, as shown. Preferably, top left hinge 468 comprises bracket 705, axle 706, and pin 707, as shown. Preferably, bracket 705 is fixedly attached to screen assembly 104, as shown. Preferably, axle 706 is fixedly attached to the end of left vertical bar 431, as shown. Preferably, bracket 705 comprises holes 704, as shown. Preferably, axle 706 is positioned in bracket 705 and pin 707 is put through holes 704 and axle 706 to hingedly attach left vertical bar 431 to screen assembly 104, as shown.

FIG. 8 shows a perspective view illustrating left vertical bar 431 according to FIG. 1A. Preferably, left vertical bar 431 and right vertical bar 441 are interchangeable.

Figure 9:
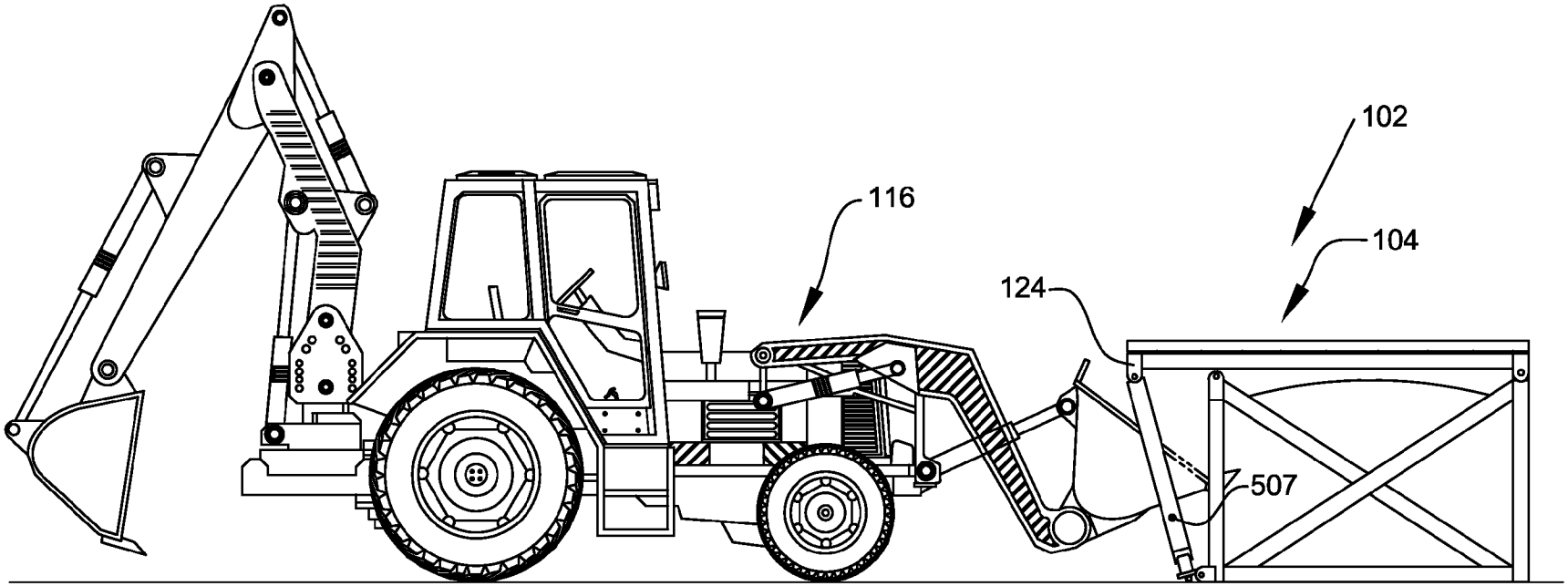
FIG. 9 shows a side view illustrating a preferred step in the adjustment of the material screener from a stowed configuration to an operable configuration.

FIG. 9 shows a side view illustrating a preferred step in the adjustment of material screener 102 from a stowed configuration to an operable configuration. Preferably, pin 507 is removed from holes 504 and axle 506 (on both left and right sides), and pin 510 is inserted through inner telescoping rod 512 (through an adjustment aperture 513) and outer telescoping sleeve 514 (through retainer aperture 515) of left vertical bar 431, as shown, prior to raising rear support 124.

Figure 10:
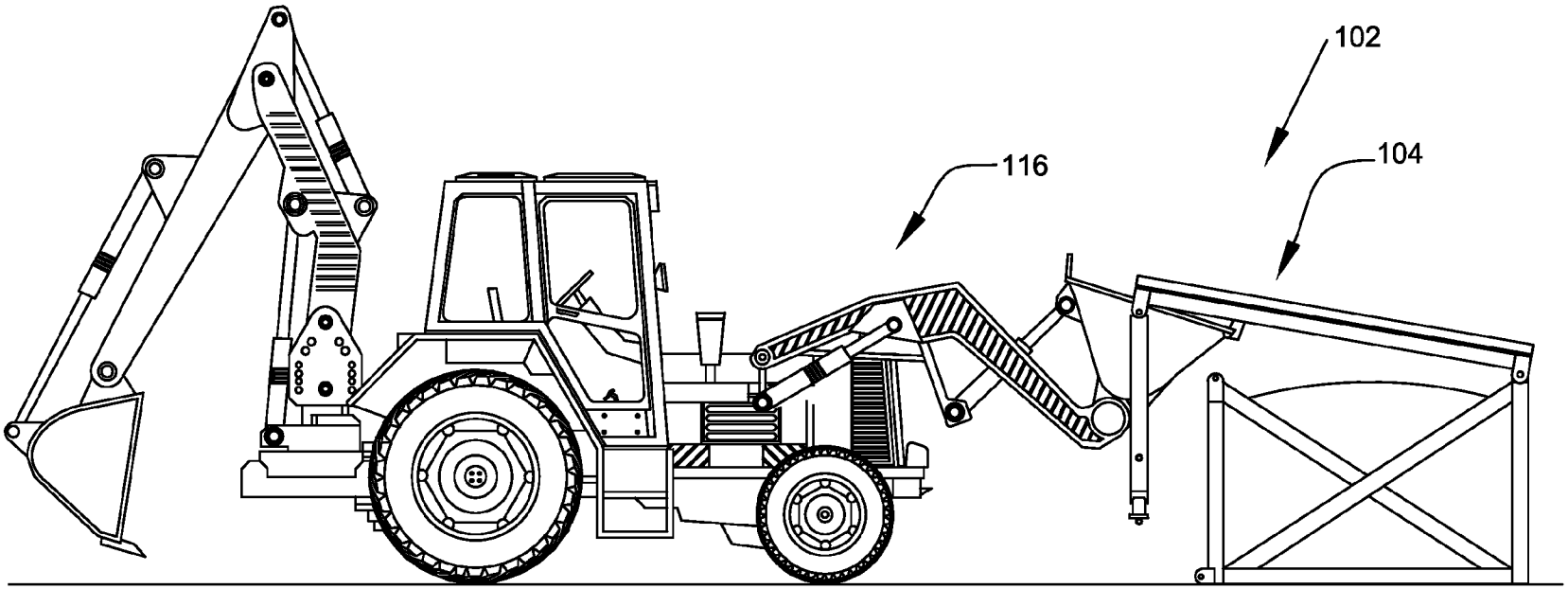
FIG. 10 shows a side view illustrating a succeeding preferred step in the adjustment of the material screener from a stowed configuration to an operable configuration.

FIG. 10 shows a side view illustrating a succeeding preferred step in the adjustment of material screener 102 from a stowed configuration to an operable configuration. Preferably, lifting equipment, such as the bucket of tractor 116, is used to raise screen assembly 104, as shown.

Figure 11:
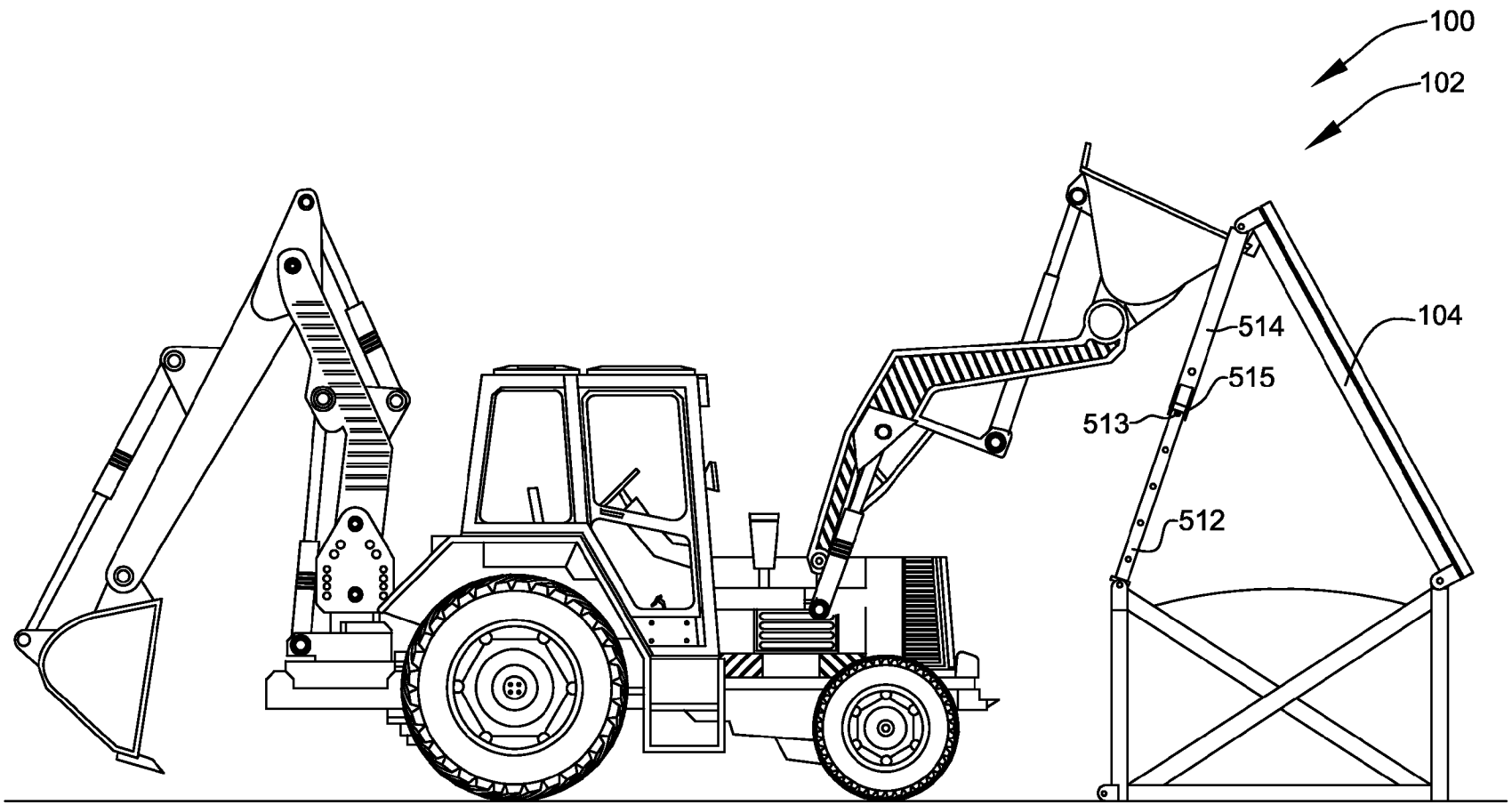
FIG. 11 shows a side view illustrating a subsequent preferred step in the adjustment of the material screener from a stowed configuration to an operable configuration.

FIG. 11 shows a side view illustrating a subsequent preferred step in the adjustment of material screener 102 from a stowed configuration to an operable configuration. Preferably, screen assembly 104 is raised until notch 515 of outer telescoping sleeve 514 is positioned past the last adjustment aperture 513, as shown.

Figure 12:
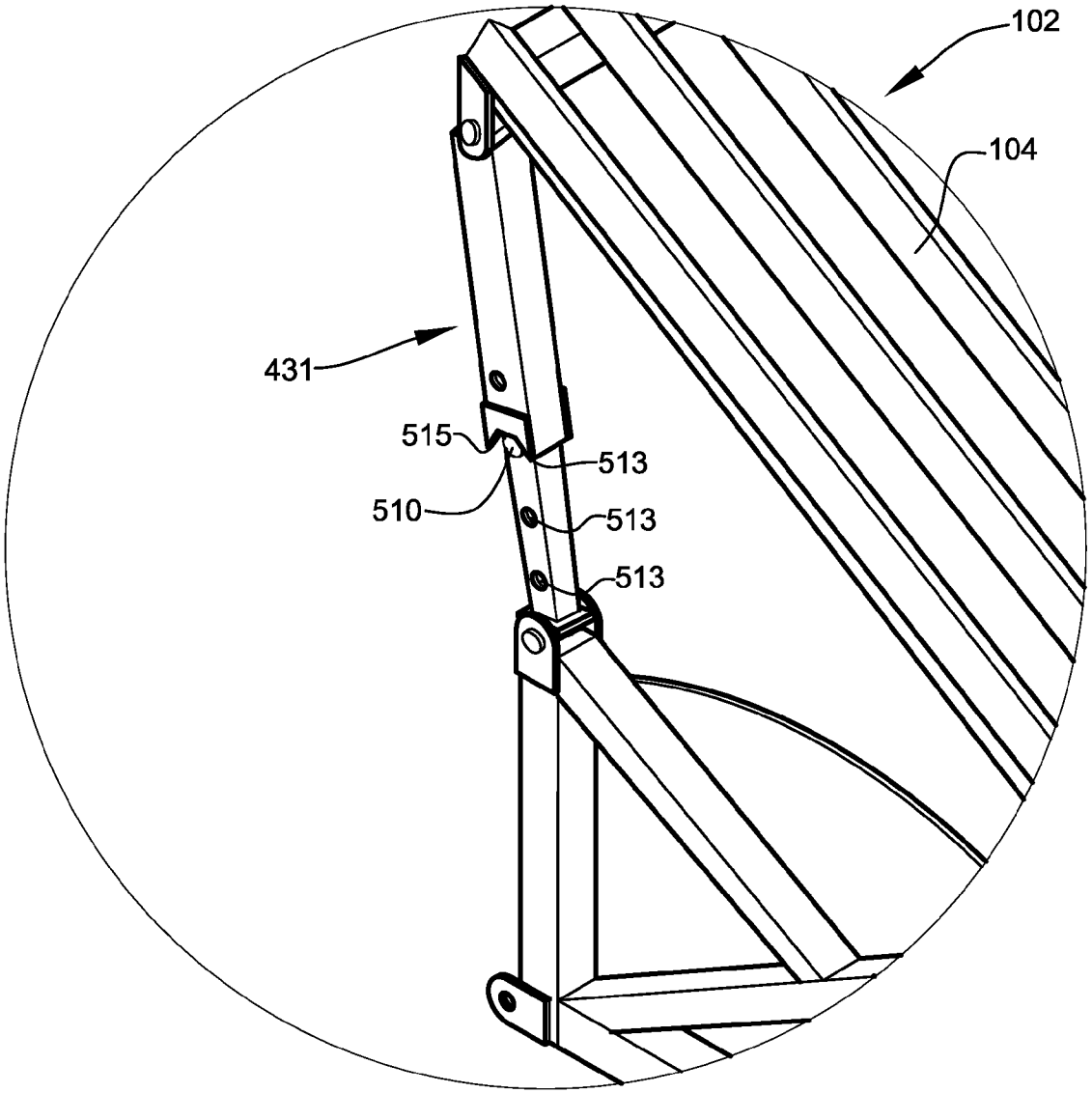
FIG. 12 shows a perspective view illustrating a subsequent preferred step in the adjustment of the material screener from a stowed configuration to an operable configuration.

FIG. 12 shows a perspective view illustrating a subsequent preferred step in the adjustment of material screener 102 from a stowed configuration to an operable configuration. Preferably, after screen assembly 104 is raised, pin 510 is inserted into desired adjustment aperture 513, in both left vertical bar 431, as shown, and right vertical bar 441. Preferably, outer telescoping sleeve 514 is then lowered until notch 515 of outer telescoping sleeve 514 rests on pin 510, as shown.

It should be noted, that in the highly preferred arrangements of the depicted embodiment, the operator is required to thread pin 510 through only adjustment aperture 513 of inner telescoping rod 512, as shown. The user is not required to align, for example, apertures located within both the inner and outer telescoping members. This highly preferred and novel feature allows a single operator to quickly and efficiently adjust the angular position of screen assembly 104.

Figure 13:
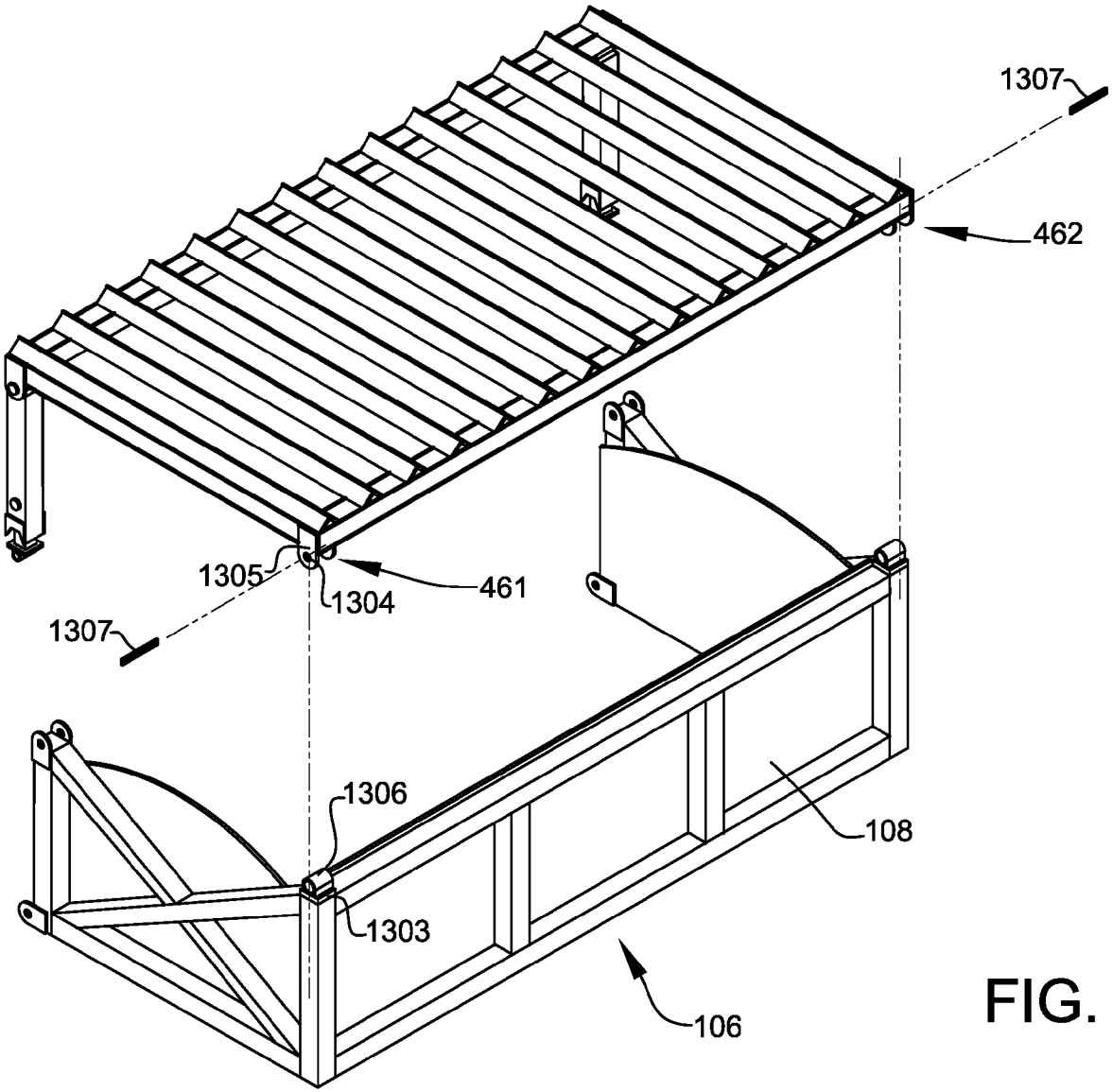
FIG. 13 shows a perspective view illustrating the left front hinge and the right front hinge, according to the preferred embodiment of FIG. 1A.

FIG. 13 shows a perspective view illustrating left front hinge 461 and right front hinge 462, according to the preferred embodiment of FIG. 1A. Preferably, left front hinge 461 comprises left front bracket 1305, axle 1306, and pin 1307, as shown. Preferably, left front bracket 1305 is fixedly attached to the bottom of screen assembly 104, as shown. Preferably, axle 1306 is fixedly attached to support base 106, as shown. Preferably, left front bracket 1305 comprises holes 1304, as shown. Preferably, axle 1306 is positioned in bracket 1305 and pin 1307 is put through holes 1304 and axle 1306 to hingedly attach screen assembly 104 to support base 106, as shown. Preferably, right front hinge 462 is constructed substantially identically to left front hinge 461, as shown.

Preferably, axle 1306 comprises riser 1303, as shown. Preferably, riser 1303 raises the hole of axle 1306 above the top of front wall 108 to accommodate the length of left front bracket 1305, as shown.

Note the preferred use of a gusset to stabilize and strengthen the upper front corner of base support 106.

Figure 14:
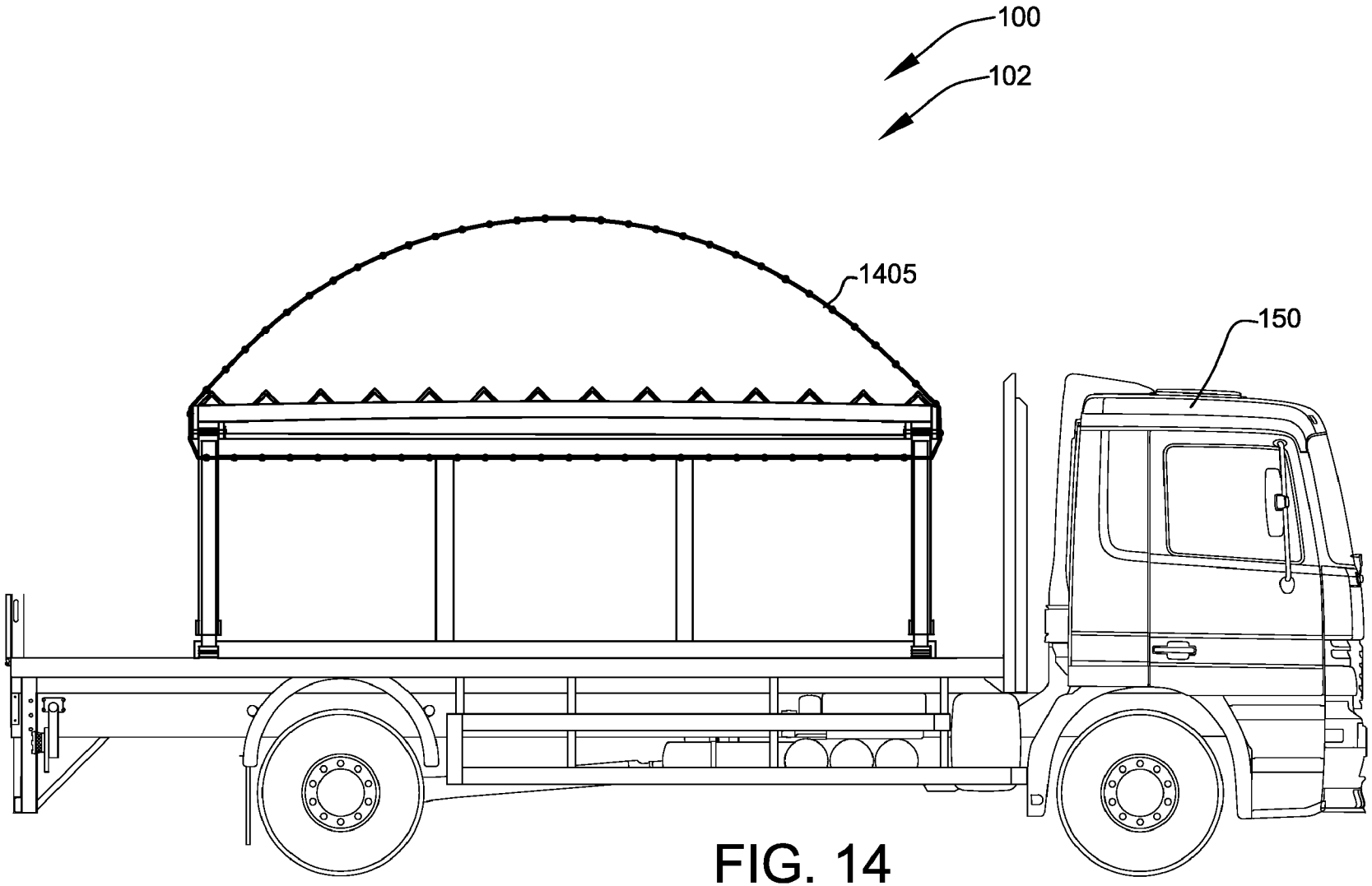
FIG. 14 shows a side view illustrating a first step of deploying the material screener from a transport vehicle to the site of operation.
Figure 15:
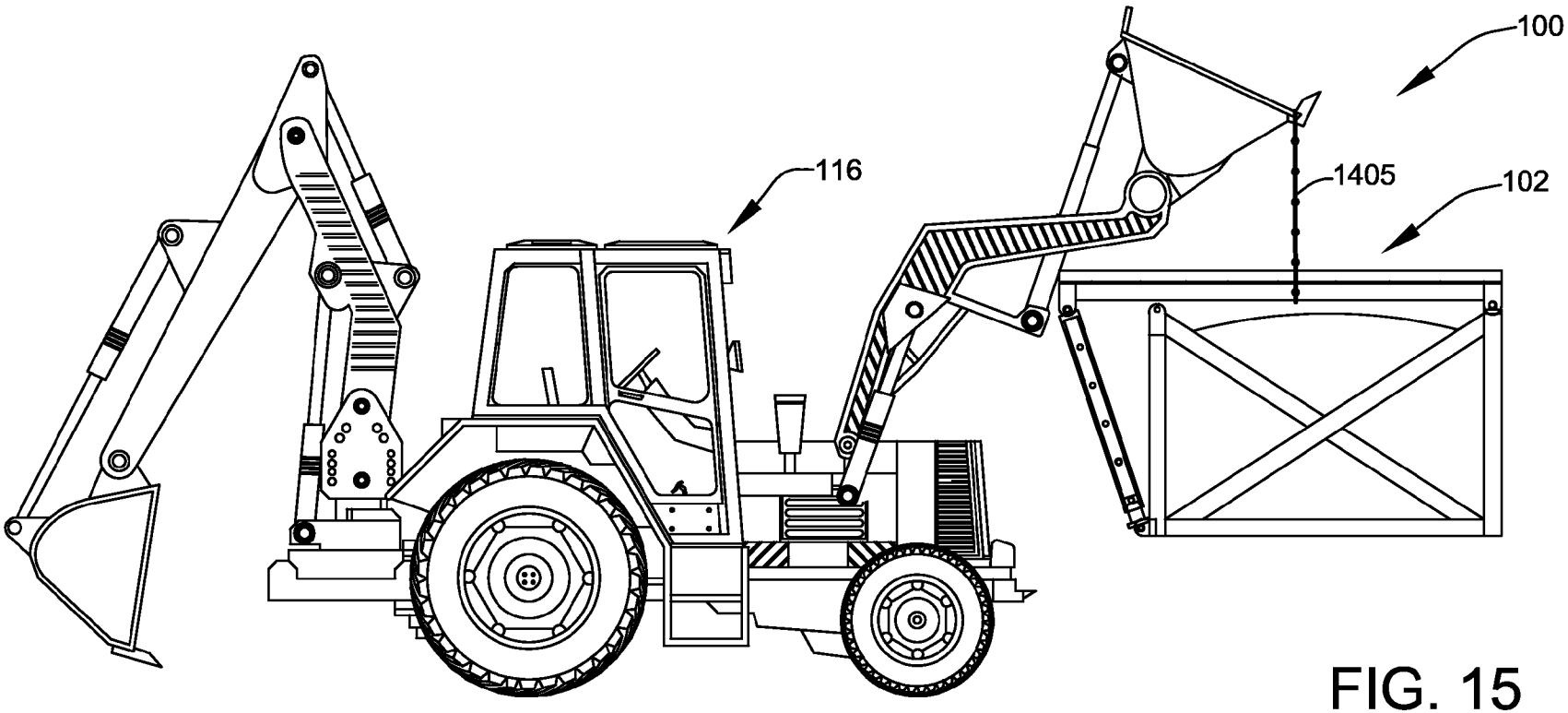
FIG. 15 shows a side view illustrating a second step of deploying the material screener from a transport vehicle to the site of operation.
Figure 19:
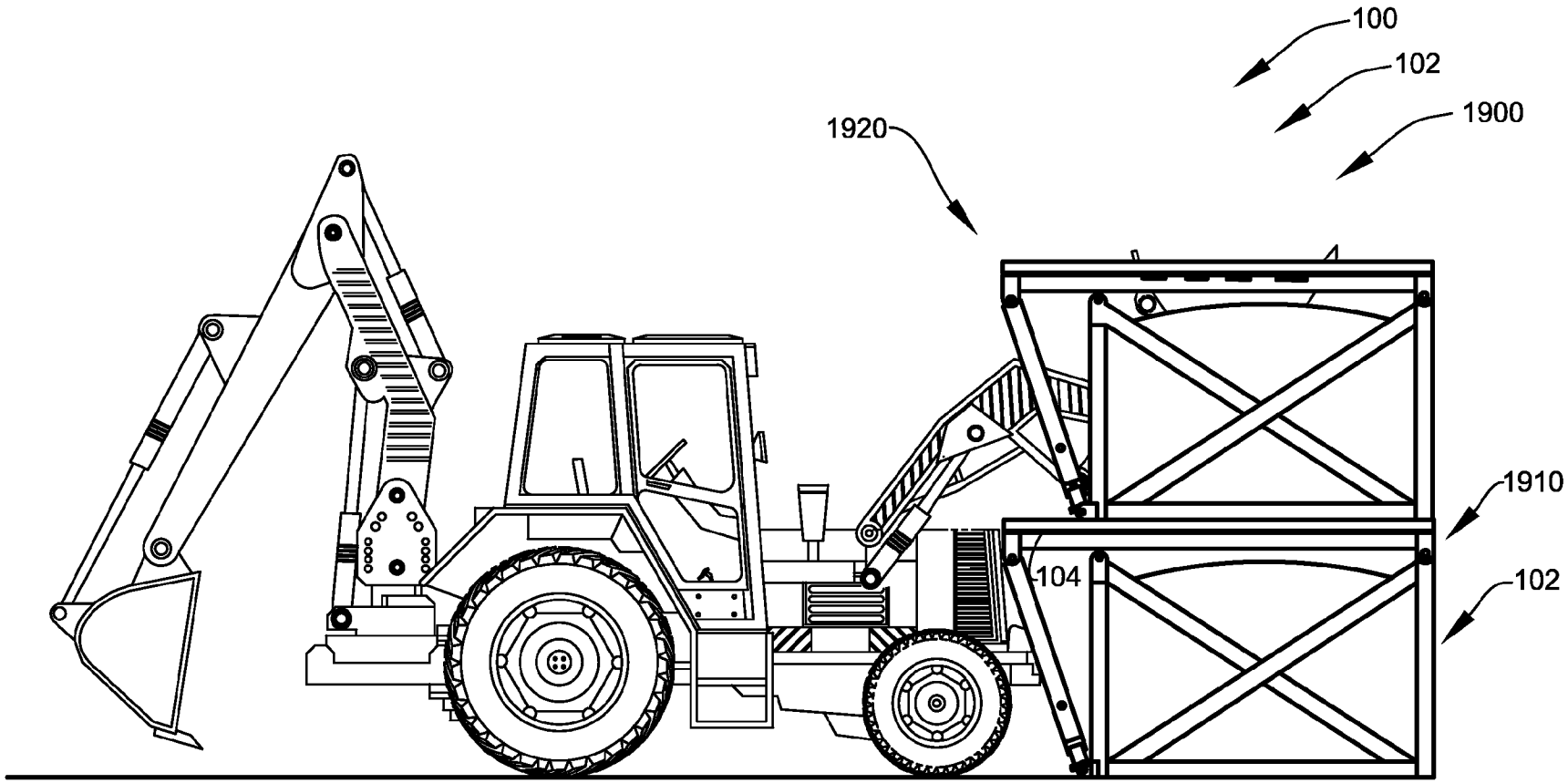
FIG. 19 shows a side view illustrating a method according to the preferred embodiment of the present invention.

FIGS. 14 and 15 show side views illustrating the deployment of material screener 102 from transport vehicle 150 to the site of operation. The preferred fold-down arrangement of the present invention allows for transport on standard flatbed trailers, as shown. In addition, the stowed configuration of material screener 102 allows for stacking of units during storage or transportation, as shown in FIG. 19. Preferably, the low profile of material screener 102 provides convenient portability using moderately sized tractor equipment using lift-chain 1405, as shown.

Figures 16, 17, 18:
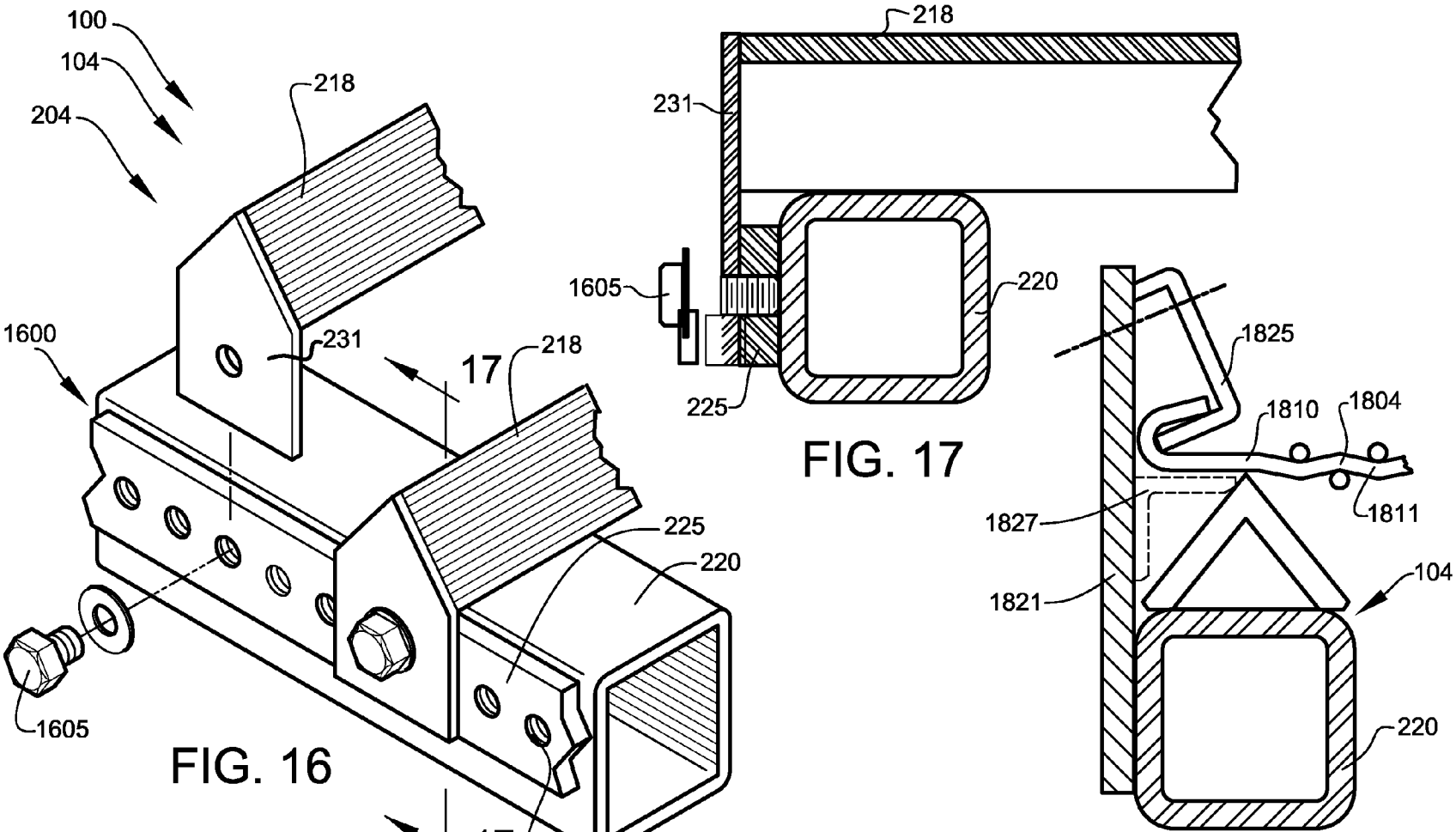
FIG. 16 shows a partial perspective view illustrating a separator screen comprising adjustable screen members, according to the preferred embodiment of the present invention.
FIG. 17 shows a sectional view through the section 17-17 of FIG. 16.
FIG. 18 shows a sectional view illustrating the mounting of a secondary separator screen over the screen assembly, according to another preferred embodiment of the present invention.

FIG. 16 shows a partial perspective view illustrating separator screen 204 comprising adjustable screen members 218, according to the preferred embodiment of the present invention. Preferably, screen assembly 104 comprises screen assembly 204, as shown. Preferably, screen assembly 204 comprises adjuster 1600. Preferably, adjuster 1600 comprises a plurality of adjustable screen members 218 adjustably attachable within a modified support frame 220, as shown. Preferably, three-quarter inch plate 225, having threaded apertures 227 spaced at intervals (preferably one-inch intervals), is welded to the outside face of support frame 220, between the upper hinges, as shown. Preferably, aperture containing end plates 231 are welded to screen members 218, as shown. Threaded fasteners 1605 are preferably used to firmly and removably retain end plates 231 to support frame 220, as shown. Preferably, adjustment in the spacing between screen members 218 with adjuster 1600 (at least embodying herein at least one adjuster structured and arranged to adjust the spacing among such plurality of screen members, wherein adjustment of such plurality of screen members adjusts the size of such coarser parts of such excavated material blocked by such plurality of screen members, and such size of such finer parts passed by such plurality of screen members) modifies the size of the coarser parts of the excavated material blocked by screen assembly 204, (and the size of the finer parts passed by separator screen assembly 204), as shown. Upon reading the teachings of this specification, those skilled in the art will now understand that, under appropriate circumstances, considering such issues as advances in technology, user preference, etc., other adjustment mechanisms, such as sliding adjustment, other screen member fasteners, etc., may suffice.

FIG. 17 shows a sectional view through the section 17-17 of FIG. 16.

FIG. 18 shows a sectional view illustrating the mounting of a secondary separator screen 1804, over screen assembly 104, according to another preferred embodiment of the present invention. Preferably, screen assembly 104 comprises modified support frame 220 comprising at least one secondary screen mount 1821 structured and arranged to removably mount secondary separator screen 1804, as shown. Preferably, secondary separator screen 1804 comprises at least one woven wire screen 1810 (at least embodying herein wherein such at least one support frame comprises at least one secondary screen mount structured and arranged to removably mount at least one secondary woven wire screen), as shown. More preferably, secondary woven wire screen 1810 comprises at least one commercially available woven wire vibrator screen 1811 (at least embodying herein wherein such at least one secondary woven wire screen comprises at least one woven wire vibrator deck screen) usable in at least one vibrator deck, preferably of a stock size and configuration (preferably about eight feet wide by about twelve feet long). Upon reading the teachings of this specification, those skilled in the art will now understand that, under appropriate circumstances, considering such issues as advances in technology, user preference, etc., other screens, such as wire mesh, a woven screen instead of screen members, etc., may suffice.

Preferably, secondary screen mount 1821 comprises crimper 1825, as shown. Preferably, crimper 1825 holds woven wire screen 1810 to secondary screen mount 1821, as shown, either fixedly or with removable fasteners. Preferably, secondary screen mount 1821 fits over support frame 220, as shown, either held by gravity or by removable fasteners. Preferably, optional angle 1827 assists in securing woven wire screen 1810, as shown. Upon reading the teachings of this specification, those skilled in the art will now understand that, under appropriate circumstances, considering such issues as advances in technology, user preference, etc., other means for securing a wire screen over the support frame, such as using a wire screen instead of screen members, other removable attachers, welding, etc., may suffice.

For durability, each of the above-described embodiments are preferably constructed substantially from metal components, most preferably steel. Preferably, the above-described embodiments are prefabricated from stock steel shapes and modified steel plates. Preferably, all permanent (non-pivoting) connections are formed by welding. Upon reading the teachings of this specification, those skilled in the art will now understand that, under appropriate circumstances, considering such issues as advances in technology, user preference, etc., other manufacturing methods, such as molding, bolting, riveting, adhesive connections, etc., may suffice.

FIG. 19 shows a side view illustrating method 1900 according to the preferred embodiment of the present invention. Preferably, material screening system 100 comprises method 1900, as shown. Preferably, method 1900 comprises the steps of: configuring (step 1910) at least one screen surface (preferably screen assembly 104) of at least one first grizzly-type material screener (preferably material screener 102) to comprise a substantially horizontal screen position; and supportably stacking (step 1920) at least one second grizzly-type material screener (preferably another material screener 102) on such at least one first grizzly-type material screener; wherein such at least one screen surface is structured and arranged to screen coarser parts of excavated material from finer parts of such excavated material; and wherein such at least one screen surface is configurable to at least one non-horizontal position, as shown (at least embodying herein the step of configuring at least one screen surface of at least one first grizzly-type material screener to comprise a substantially horizontal screen position; and at least embodying herein the step of supportably stacking at least one second grizzly-type material screener on such at least one first grizzly-type material screener; and at least embodying herein wherein such at least one screen surface is structured and arranged to screen coarser parts of excavated material from finer parts of such excavated material; and at least embodying herein wherein such at least one screen surface is configurable to at least one non-horizontal position). Upon reading the teachings of this specification, those skilled in the art will now understand that, under appropriate circumstances, considering such issues as advances in technology, user preference, etc., other method steps, such as adjusting the angle using a single person, raising the screen with a piece of ground-moving equipment, lifting the material screener suspended by a chain, etc., may suffice.

Figure 20:
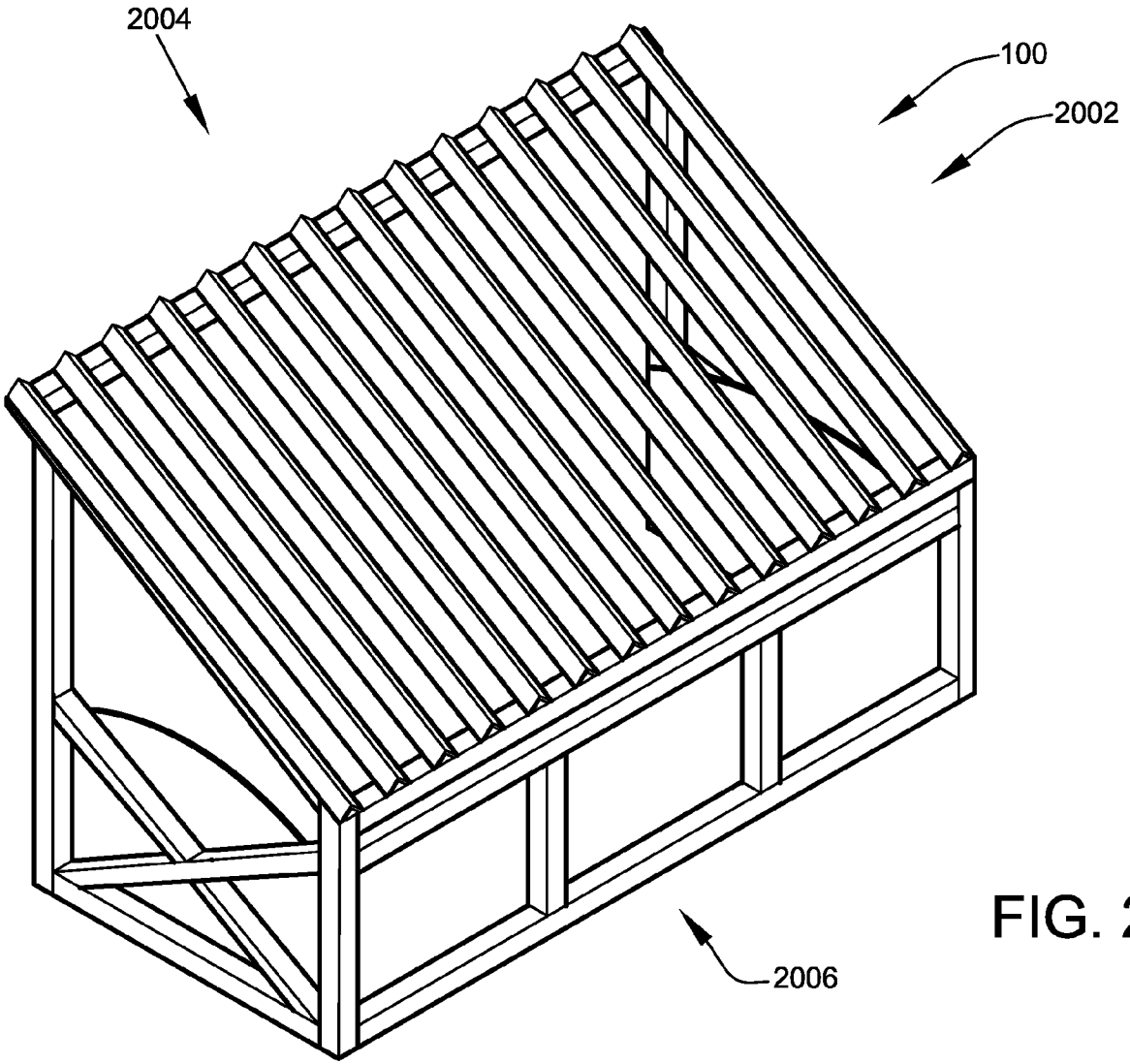
FIG. 20 shows a perspective view illustrating another material screener according to the preferred embodiment of the present invention.

FIG. 20 shows a perspective view illustrating material screener 2002 according to another preferred embodiment of the present invention.

Preferably, material screening system 100 comprises material screener 2002, as shown. Preferably, material screener 2002 comprises at least one screen assembly 2004 and base support 2006, as shown. Preferably, material screener 2002 is substantially identical to material screener 102, but without the adjustability function and structures, as shown.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A material screening system, relating to screening coarser parts of excavated material from finer parts of such excavated material, comprising:

a) at least one screen structured and arranged to screen such coarser parts of such excavated material from such finer parts of such excavated material;

b) at least one vertical support, structured and arranged to vertically support said at least one screen above at least one ground surface, comprising i) at least one front wall having at least one in-side, at least one out-side, at least one left edge, at least one right edge, at least one bottom edge, and at least one top edge;

ii) at least one left side wall, comprising at least one left front end and at least one left back end, wherein said at least one left front end is fixedly connected to said at least one left edge;

iii) at least one right side wall, comprising at least one right front end and at least one right back end, wherein said at least one right front end is fixedly connected to said at least one right edge, iv) wherein said at least one left side wall and said at least one right side wall are substantially parallel;

v) wherein said at least one left side wall comprises at least one left substantially vertical bar member extending generally upward from said at least one left back end; and vi) wherein said at least one right side wall comprises at least one right substantially vertical bar member extending generally upward from said at least one right back end;

vii) wherein said at least one left side wall comprises at least one left diagonal cross-brace member structured and arranged to provide diagonal cross-brace support between said at least one front wall and said at least one left substantially vertical bar member;

viii) wherein said at least one right side wall comprises at least one right diagonal cross-brace member structured and arranged to provide diagonal cross-brace support between said at least one front wall and said at least one right substantially vertical bar member;

c) wherein said at least one screen is attached to said at least one vertical support; and d) wherein said at least one screen comprises:

i) a plurality of screen members structured and arranged to block the passage of such coarser parts of such excavated material and to allow passage of such finer parts of such excavated material; and ii) at least one support frame structured and arranged to support said plurality of screen members;

e) wherein said at least one support frame comprises at least one camber structured and arranged to compensate for at least one deflection generated within said at least one support frame under at least one operational load.

2. The material screening system, according to claim 1, further comprising at least one adjuster structured and arranged to adjust the spacing among said plurality of screen members, wherein adjustment of said plurality of screen members adjusts the size of such coarser parts of such excavated material blocked by said plurality of screen members, and such size of such finer parts passed by said plurality of screen members.

3. The material screening system, according to claim 2, wherein at least one of said plurality of screen members comprises at least one triangular cross-section, wherein the base of said at least one triangular cross-section is oriented adjacent said at least one support frame.

4. The material screening system, according to claim 1, wherein said at least one support frame comprises at least one secondary screen mount structured and arranged to removably mount at least one secondary screen.

5. The material screening system, according to claim 4, further comprising at least one secondary screen, wherein said at least one secondary screen comprises at least one woven wire screen.

6. The material screening system, according to claim 1, further comprising at least one angle adjuster structured and arranged to adjust the angle of said at least one screen relative to the at least one ground surface.

7. The material screening system, according to claim 6, wherein a) said at least one left substantially vertical bar member comprises at least one left angle adjuster structured and arranged to adjust the angle of said at least one left substantially vertical bar member relative to the at least one ground surface; and b) said at least one right substantially vertical bar member comprises at least one right angle adjuster structured and arranged to adjust the angle of said at least one right substantially vertical bar member relative to the at least one ground surface.

8. The material screening system, according to claim 7, wherein a) said at least one left angle adjuster comprises at least one left length adjuster structured and arranged to adjust the length of said at least one left substantially vertical bar member; and b) said at least one right angle adjuster comprises at least one right length adjuster structured and arranged to adjust the length of said at least one right substantially vertical bar member.

9. The material screening system, according to claim 8, wherein a) said at least one left length adjuster comprises at least one left inner telescoping bar and at least one left outer telescoping sleeve; and b) said at least one right length adjuster comprises at least one right inner telescoping bar and at least one right outer telescoping sleeve.

10. The material screening system, according to claim 9, further comprising a) at least one left length selector structured and arranged to selectably fix the relative positions of said at least one left inner telescoping bar and said at least one left outer telescoping sleeve; and b) at least one right length selector structured and arranged to selectably fix the relative positions of said at least one right inner telescoping bar and said at least one right outer telescoping sleeve.

11. The material screening system, according to claim 10, wherein a) said at least one left inner telescoping bar is hingedly connected to said at least one left back end;

b) said at least one left outer telescoping sleeve is hingedly connected to said at least one screen;

c) said at least one right inner telescoping bar is hingedly connected to said at least one right back end; and d) said at least one right outer telescoping sleeve is hingedly connected to said at least one screen.

12. The material screening system, according to claim 10, wherein a) said at least one left length selector comprises i) at least one pin-hole through said at least one left inner telescoping bar; and ii) at least one pin structured and arranged to pierce said at least one pin-hole and to support at least one end of said at least one left outer telescoping sleeve; and b) said at least one right length selector comprises i) at least one pin-hole through said at least one right inner telescoping bar; and ii) at least one pin structured and arranged to pierce said at least one pin-hole and to support at least one end of said at least one right outer telescoping sleeve.

13. The material screening system, according to claim 6, wherein said at least one screen is hingedly attached to said at least one top edge of said at least one front wall.

14. The material screening system, according to claim 6, wherein said at least one angle adjuster is structured and arranged to adjust the angle of said at least one screen between horizontal and past vertical, relative to the at least one ground surface.

15. The material screening system, according to claim 6, wherein said at least one angle adjuster comprises at least one positional retainer structured and arranged to firmly retain said at least one screen in a horizontal position during transport.

16. A material screening system, relating to screening coarser parts of excavated material from finer parts of such excavated material, comprising:

a) at least one screen structured and arranged to screen such coarser parts of such excavated material from such finer parts of such excavated material;

b) at least one vertical support, structured and arranged to vertically support said at least one screen above at least one ground surface, comprising i) at least one front wall having at least one in-side, at least one out-side, at least one left edge, at least one right edge, at least one bottom edge, and at least one top edge, ii) at least one left side wall, comprising at least one left front end and at least one left back end, wherein said at least one left front end is fixedly connected to said at least one left edge, iii) at least one right side wall, comprising at least one right front end and at least one right back end, wherein said at least one right front end is fixedly connected to said at least one right edge, iv) wherein said at least one left side wall comprises at least one left substantially vertical bar member extending generally upward from said at least one left back end, and v) wherein said at least one right side wall comprises at least one right substantially vertical bar member extending generally upward from said at least one right back end;

c) at least one angle adjuster structured and arranged to adjust the angle of said at least one screen relative to the at least one ground surface, comprising i) at least one front hinge structured and arranged to hingedly attach said at least one screen to said at least one front wall, ii) at least one first left hinge structured and arranged to hingedly connect said at least one screen to said at least one left substantially vertical bar member, iii) at least one second left hinge structured and arranged to hingedly connect said at least one left side wall to said at least one left substantially vertical bar member, iv) at least one first right hinge structured and arranged to hingedly connect said at least one screen to said at least one right substantially vertical bar member, v) at least one second right hinge structured and arranged to hingedly connect said at least one right side wall to said at least one right substantially vertical bar member, vi) at least one left length adjuster structured and arranged to adjust the length of said at least one left substantially vertical bar member, and vii) at least one right length adjuster structured and arranged to adjust the length of said at least one right substantially vertical bar member.

17. The material screening system, according to claim 16, wherein said at least one screen comprises:

a) a plurality of screen members structured and arranged to block the passage of such coarser parts of such excavated material and to allow the passage of such finer parts of such excavated material; and b) at least one support frame structured and arranged to support said plurality of screen members.

18. The material screening system, according to claim 17, wherein at least one of said plurality of screen members comprises at least one triangular cross-section, wherein the base of said at least one triangular cross-section is oriented adjacent said at least one support frame.

19. The material screening system, according to claim 17, wherein said at least one support frame comprises at least one camber structured and arranged to compensate for at least one deflection generated within said at least one support frame under at least one operational load.

20. The material screening system, according to claim 17, further comprising at least one adjuster structured and arranged to adjust the spacing among said plurality of screen members, wherein adjustment of said plurality of screen members adjusts the size of such coarser parts of such excavated material blocked by said plurality of screen members, and such size of such finer parts passed by said plurality of screen members.

21. The material screening system, according to claim 17, wherein said at least one support frame comprises at least one secondary screen mount structured and arranged to removably mount at least one secondary screen.

22. The material screening system, according to claim 21, further comprising such at least one secondary screen, wherein said at least one secondary screen comprises at least one woven wire screen.

23. The material screening system, according to claim 16, wherein a) said at least one left length adjuster comprises at least one left inner telescoping bar and at least one left outer telescoping sleeve; and b) said at least one right length adjuster comprises at least one right inner telescoping bar and at least one right outer telescoping sleeve.

24. The material screening system, according to claim 23, wherein a) said at least one left inner telescoping bar is hingedly connected to said at least one left back end;

b) said at least one left outer telescoping sleeve is hingedly connected to said at least one screen;

c) said at least one right inner telescoping bar is hingedly connected to said at least one right back end; and d) said at least one right outer telescoping sleeve is hingedly connected to said at least one screen.

25. The material screening system, according to claim 23, further comprising a) at least one left length selector structured and arranged to selectably fix the relative positions of said at least one left inner telescoping bar and said at least one left outer telescoping sleeve; and b) at least one right length selector structured and arranged to selectably fix the relative positions of said at least one right inner telescoping bar and said at least one right outer telescoping sleeve.

26. The material screening system, according to claim 25, wherein a) said at least one left length selector comprises i) at least one pin-hole through said at least one left inner telescoping bar; and ii) at least one pin structured and arranged to pierce said at least one pin-hole and to support at least one end of said at least one left outer telescoping sleeve; and b) said at least one right length selector comprises i) at least one pin-hole through said at least one right inner telescoping bar; and ii) at least one pin structured and arranged to pierce said at least one pin-hole and to support at least one end of said at least one right outer telescoping sleeve.

27. The material screening system, according to claim 16, wherein said at least one angle adjuster is structured and arranged to adjust the angle of said at least one screen between horizontal and past vertical, relative to the at least one ground surface.

28. The material screening system, according to claim 16, wherein said at least one angle adjuster comprises at least one positional retainer structured and arranged to firmly retain said at least one screen in a horizontal position during transport.

* * * * *